US007784141B2

(12) United States Patent
Knopow et al.

(10) Patent No.: US 7,784,141 B2
(45) Date of Patent: Aug. 31, 2010

(54) FLEXIBLE CLEANING TOOL WITH REPLACEABLE NON-WOVEN PAD AND CLEANING FLUID RESERVOIR

(75) Inventors: Jeremy F. Knopow, Burlington, WI (US); Micah L. Maraia, Menomonie, WI (US); Scott A. Olson, Chippewa Falls, WI (US); Aaron J. Munsinger, Cold Spring, MN (US); Chris L. Peterson, Chippewa Falls, WI (US); David A. Hoadley, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 1232 days.

(21) Appl. No.: 11/238,866

(22) Filed: Sep. 29, 2005

(65) Prior Publication Data

US 2006/0200929 A1 Sep. 14, 2006

Related U.S. Application Data

(63) Continuation-in-part of application No. 11/045,204, filed on Jan. 28, 2005, and a continuation-in-part of application No. 11/106,960, filed on Apr. 15, 2005, now Pat. No. 7,356,869, and a continuation-in-part of application No. 11/124,527, filed on May 6, 2005, and a continuation-in-part of application No. 11/124,878, filed on May 9, 2005.

(51) Int. Cl.
*A47L 13/10* (2006.01)

(52) U.S. Cl. ..... 15/210.1; 15/209.1; 15/234

(58) Field of Classification Search ..... 15/210.1, 15/209.1, 234, 104.31, 159.1, 160, 172
See application file for complete search history.

(56) References Cited

U.S. PATENT DOCUMENTS

| | | | |
|---|---|---|---|
| 377,582 | A | 2/1888 | Stewart |
| 566,570 | A | 8/1896 | Frick |
| 782,669 | A | 2/1905 | Lea |
| 823,725 | A | 6/1906 | Hayden |
| 986,268 | A | 3/1911 | Colina et al. |
| 1,261,444 | A | 4/1918 | Schied |
| 1,466,723 | A | 9/1923 | Izawa |
| 1,559,900 | A | 11/1925 | McCarthy |
| 1,588,737 | A | 6/1926 | Hurd |
| 1,608,347 | A | 11/1926 | Thompson |
| 1,796,001 | A | 3/1931 | Church |
| 1,844,443 | A | 2/1932 | Markowitz |
| 1,928,328 | A | 9/1933 | Carpentier |
| 2,003,243 | A | 5/1935 | Campbell et al. |
| 2,062,065 | A | 11/1936 | Miley |
| 2,254,365 | A | 9/1941 | Griffith et al. |
| 2,303,660 | A | 12/1942 | Schickel |
| 2,438,268 | A | 3/1948 | Bressler |

(Continued)

OTHER PUBLICATIONS

International Search Report and Written Opinion dated Mar. 29, 2007, Appl. No. PCT/US06/13974.

*Primary Examiner*—Lee D Wilson

(57) ABSTRACT

A flexible cleaning tool for use in wet, damp or dry cleaning is disclosed. The cleaning tool (222), (322) includes a handle (224) defining a fluid reservoir receiving cradle (231) pivotally connected to an elongated flexible support member (226) (326). A cleaning pad (228) (328) encloses the support rod (226) (326).

21 Claims, 8 Drawing Sheets

U.S. PATENT DOCUMENTS 2,479,224 A 8/1949 Flinn
2,529,952 A 11/1950 Leunis
2,746,074 A 5/1956 Carlson, Sr.
2,871,497 A 2/1959 Miller et al.
2,877,482 A 3/1959 Roy
3,066,344 A 12/1962 Borras et al.
D198,742 S 7/1964 Bennett
3,205,518 A 9/1965 Romaine
3,360,818 A 1/1968 Edwards
4,145,787 A 3/1979 Bastian
4,227,278 A 10/1980 Raskin et al.
4,483,037 A 11/1984 Jacobson
4,683,875 A 8/1987 Rabinowitz
4,765,014 A 8/1988 Moss et al.
4,819,294 A * 4/1989 Calvert ..... 15/209.1
4,827,556 A 5/1989 Corsetti
4,829,621 A 5/1989 Phenegar
4,908,900 A 3/1990 McLaughlin et al.
4,926,522 A 5/1990 Wang
4,949,496 A 8/1990 Stephan
4,967,441 A 11/1990 White
5,032,015 A 7/1991 Christianson
5,033,155 A 7/1991 Klotz
5,033,528 A 7/1991 Volcani
5,158,532 A 10/1992 Peng et al.
5,279,048 A 1/1994 Lawall et al.
5,449,006 A 9/1995 Hogan et al.
5,449,206 A 9/1995 Lockwood
D364,016 S 11/1995 Aronson
5,479,951 A 1/1996 Denebeim
D371,655 S 7/1996 Weston
5,555,588 A 9/1996 Viesehon
5,806,128 A 9/1998 Love
5,836,032 A 11/1998 Hondo
5,997,047 A 12/1999 Pimentel et al.
6,042,155 A 3/2000 Lockwood
D428,225 S 7/2000 Prime et al.
6,082,583 A * 7/2000 Bussell et al. ..... 222/1
6,086,759 A 7/2000 Bisseker
RE36,883 E 9/2000 Krenzel
D435,948 S 1/2001 Long
6,182,321 B1 2/2001 Wu
6,230,356 B1 5/2001 Hyo-Moon
6,233,771 B1 * 5/2001 Hortel et al. ..... 8/150
6,237,184 B1 5/2001 Lenaghan
6,368,003 B1 * 4/2002 Sorrell ..... 401/185
6,505,373 B2 1/2003 Van Gelder et al.
6,601,260 B2 8/2003 Lenaghan
6,739,787 B1 5/2004 Bystrom
6,775,873 B2 8/2004 Luoma
D500,183 S 12/2004 Bensussan et al.
D504,199 S 4/2005 Bensussan et al.
7,356,869 B2 * 4/2008 Knopow et al. ..... 15/210.1
2002/0120993 A1 9/2002 Busha
2003/0014827 A1 1/2003 Gray et al.
2003/0102010 A1 6/2003 Mays
2003/0131429 A1 * 7/2003 Ching-Chen ..... 15/110
2004/0016074 A1 1/2004 Tanaka
2005/0022843 A1 * 2/2005 Policicchio et al. ..... 134/6
2005/0183225 A1 8/2005 Wang
2005/0191116 A1 9/2005 Flanery et al.
2005/0198760 A1 9/2005 Tanaka et al.
2006/0048325 A1 3/2006 Tsuchiya
2006/0051434 A1 3/2006 Tsuchiya
2006/0200929 A1 * 9/2006 Knopow et al. ..... 15/210.1
2007/0169296 A1 * 7/2007 McDonald ..... 15/209.1

* cited by examiner

FLEXIBLE CLEANING TOOL WITH REPLACEABLE NON-WOVEN PAD AND CLEANING FLUID RESERVOIR

RELATED APPLICATIONS

This application is a continuation-in-part of U.S. patent application Ser. Nos. 11/045,204, filed Jan. 28, 2005, 11/106,960 filed Apr. 15, 2005 now U.S. Pat. No. 7,356,869, 11/124,527 filed May 6, 2005 and 11/124,878 filed May 9, 2005 the entireties of which are incorporated by reference herein.

BACKGROUND OF THE INVENTION

1. Field of the Invention

The present invention relates to the field of cleaning devices such as hand held dusters and dust mops, bathroom cleaners, toilet cleaners and other cleaning devices. More particularly, the present invention relates to a flexible cleaning device for accommodating the cleaning or dusting of difficult to access surfaces having a handle defining a cradle for receiving a fluid reservoir attached to a support arm for mounting a cleaning implement. The entire system is capable of either wet, damp or dry dusting or cleaning.

2. Discussion of the Related Art

For decades, hand held feather dusters, dust rags and other cleaning implements have been used as cleaning tools for the removal of dust adhering to furniture such as dressers and coffee tables, electrical appliances such as computers, lights, interior walls, lintels and the like. Thus, it is generally well known to remove dust or dirt from floors, furniture, and other household surfaces by rubbing a dust rag, cloth or other cleaning implement against the surface to be cleaned such that the dust or dirt adheres to the cleaning implement.

Despite the existence of numerous dusting or cleaning implements, dusting or cleaning of surfaces in hard to reach and inaccessible areas remains a common problem. Currently, in order to clean behind a heavy appliance such as a television or stereo, a user must physically move the appliance to enable the user to adequately clean behind it. Certain fixtures, such as radiators and base board heaters in older homes are immovable and present a significant challenge for cleaning. Likewise, other odd shaped or difficult to reach surfaces such as the inner rim of a toilet seat or the spindle on a staircase provide challenges to cleaning.

While hand held dusters and other cleaning implements are generally well known in the art, numerous drawbacks exist with the current commercially available designs. For example, U.S. Application Pub. No. US 2004/0034956 A1, U.S. Pat. No. 6,813,801, U.S. Pat. No. 5,953,784 and U.S. Pat. No. 6,550,092, disclose variations of hand held cleaning devices incorporating a disposable cleaning pad. These devices, while somewhat suitable for the desired application, exhibit notable limitations. For example, none of the above-cited references provide an elongated flexible support arm that allows a user to bend the duster or cleaning device into a variety of shapes. Instead, most prior art hand held dusters or cleaners utilize rigid supports that do not allow a user to shape the duster into unique configurations to enable the user to dust or clean behind hard to reach places. While some prior art devices exhibit a movable joint to enable better storage or shipping, such devices are typically constructed to be flexible only in the one direction, and as such its cleaning capability is restricted by its maneuverability. The duster of the present invention overcomes the disadvantages of the prior art since, inter alia, it is constructed of an elongated rod which is flexible in all directions.

In general, the majority of improvements to hand held dusters and cleaners have been directed at improving the basic mechanical components of the cleaning device. These improvements have been directed at providing an inexpensive yet robust implement for dry dusting or cleaning. However, notably absent in the prior art is any attempt to provide a hand held cleaning implement that allows for rotational movement to allow for a flexible cleaning device.

Likewise, the cleaning surface of the cleaning implement in many of these devices is relatively small, such that use of these cleaning devices on large surfaces requires considerable effort on the user's part. In addition, most prior art cleaning pads, only include a single cleaning surface. The duster of the present invention overcomes the disadvantages of the prior art since, inter alia, it is constructed of an elongated 360° cleaning surface.

In addition there are no known prior art hand held cleaning implements that allow for selective wet, damp or dry dusting. The addition of water or other cleaning solution to most cleaning pads or systems has been known to increase the efficiency of the cleaning device in absorbing dust and other debris. Despite this knowledge, there are presently no known hand held cleaning systems, with flexible support members that include an attached water or cleaning fluid reservoir accessible on the cleaning implement to allow a user to single handedly alternate between wet, damp or dry dusting. To date, prior art dusting and cleaning devices require a user to obtain a separate spray bottle or other liquid application means if one desires wet dusting or cleaning.

SUMMARY AND OBJECTS OF THE INVENTION

Consistent with the foregoing, and in accordance with the invention as embodied and broadly described herein, a cleaning device, a cleaning system, and a method of cleaning are disclosed in suitable detail to enable one of ordinary skill in the art to make and use the invention.

In one embodiment, a cleaning device includes a handle portion having an opening configured to allow access to a cradle, a cleaning pad support moveably attached to the handle portion and a retaining means for retaining the cleaning pad support in a desired shape. The cleaning device may include a cleaning pad enclosing the support. In one embodiment, the cleaning pad support is comprised of a plurality of interconnected segments. In an alternative embodiment, the cleaning pad support is comprised of a piece of wire insert-molded into a polymer. The polymer may be in the form of a plurality of polymer vertabrae. In yet another embodiment, the plurality of interconnected segments are in the form of a plurality of discrete rotatable interconnected segments having a male end and a female end for connecting to an adjacent discrete rotatably interconnected segment. This may be referred to as a ball and socket arrangement.

In one embodiment, a cleaning pad support is moveable between a first cleaning position and a second cleaning pad liquid application position and a cleaning fluid dispenser is housed within the cradle. The cleaning fluid dispenser may be a pump spray bottle. In still another embodiment, the cleaning pad support member is comprised of a two part support head comprising a semi-rigid first part pivotally attached to the handle portion and a flexible second part attached to the first part. The cleaning pad support member includes a circular pivot member at one end, configured to fit within a pivot member receiving cavity in the handle portion. The circular pivot member may include a plurality of notches and the handle may include a semi-flexible engagement tab projecting downward into the pivot member receiving cavity to fit within the notches for selective pivoting of the cleaning pad support.

In yet another embodiment, a cleaning system includes a cleaning tool including a handle defining an interior recess for receiving a fluid reservoir and a cleaning media support pivotally attached to the handle. The support is capable of pivoting rearwardly from a cleaning position and includes a portion moveable into a plurality of desired shapes. A cleaning media is attached to the cleaning media support and a fluid reservoir is attached to the handle in the cradle. The reservoir is capable of applying fluid to a surface to be cleaned and to the surface of the cleaning media.

In one embodiment, a cleaning media support is comprised of a two part support head comprising a semi-rigid first part pivotally attached to the handle portion and a flexible second part attached to the first part. The flexible second part may be comprised of a plurality of interconnected segments or a piece of wire or other flexible material preferably insert-molded into a polymer. In one embodiment, the piece of wire is insert-molded into a plurality of polymer vertabrae like members.

In a final embodiment, a method of cleaning includes the steps of bending a flexible support member of a cleaning tool to a desired cleaning position applying a cleaning solution from a fluid reservoir in the handle to a surface to be cleaned or to the a cleaning pad attached to the support member and moving the cleaning pad across a surface to be cleaned.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 3:
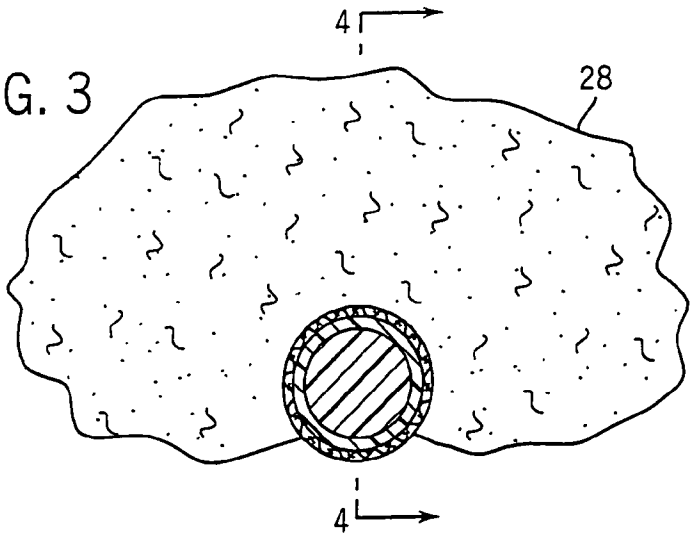
FIG. 3 a sectional view taken along line 3-3 of FIG. 1.

In describing the preferred embodiments of the invention, which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the word "connected" or "attached" terms similar thereto are often used. They are not limited to direct connection or attachment but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. SYSTEM OVERVIEW

In a basic form, the invention is a cleaning system that includes a handle, cleaning pad or duster, and a flexible cleaning pad support capable of supporting a cleaning pad or other cleaning implement. The cleaning system allows a user to dust in a variety of different places because the flexible cleaning pad support can be formed into a variety of shapes. Despite its flexibility, the support maintains its shape. A 360° cloth allows the system to be used to clean multiple surfaces at once. In additional embodiments, the cleaning system is designed for use in wet, damp or dry cleaning and includes a fluid reservoir or liquid delivery system and the cleaning pad support is moveable via a pivotable connection to the handle portion. The cleaning system allows for fluid application directly to a cleaning pad or to a surface to be cleaned. This results in a single hand operated tool that provides options for wet, damp or dry cleaning not available in traditional cleaning devices.

2. DETAILED DESCRIPTION OF PREFERRED EMBODIMENTS

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the below examples should not be construed as limiting the scope of the present invention.

Figure 1:
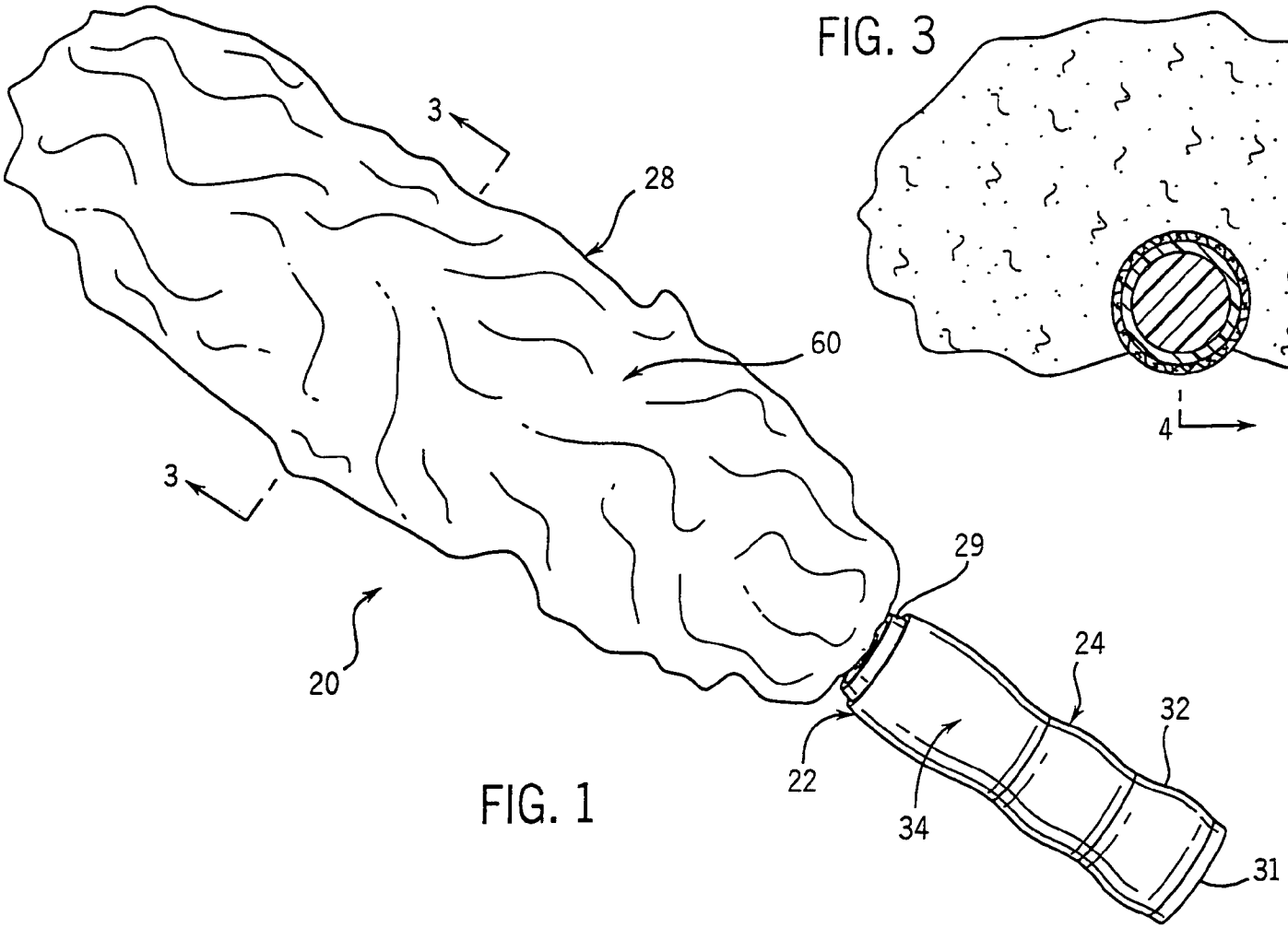
FIG. 1 is a perspective view of a first embodiment of an assembled flexible cleaning device.
Figure 2:
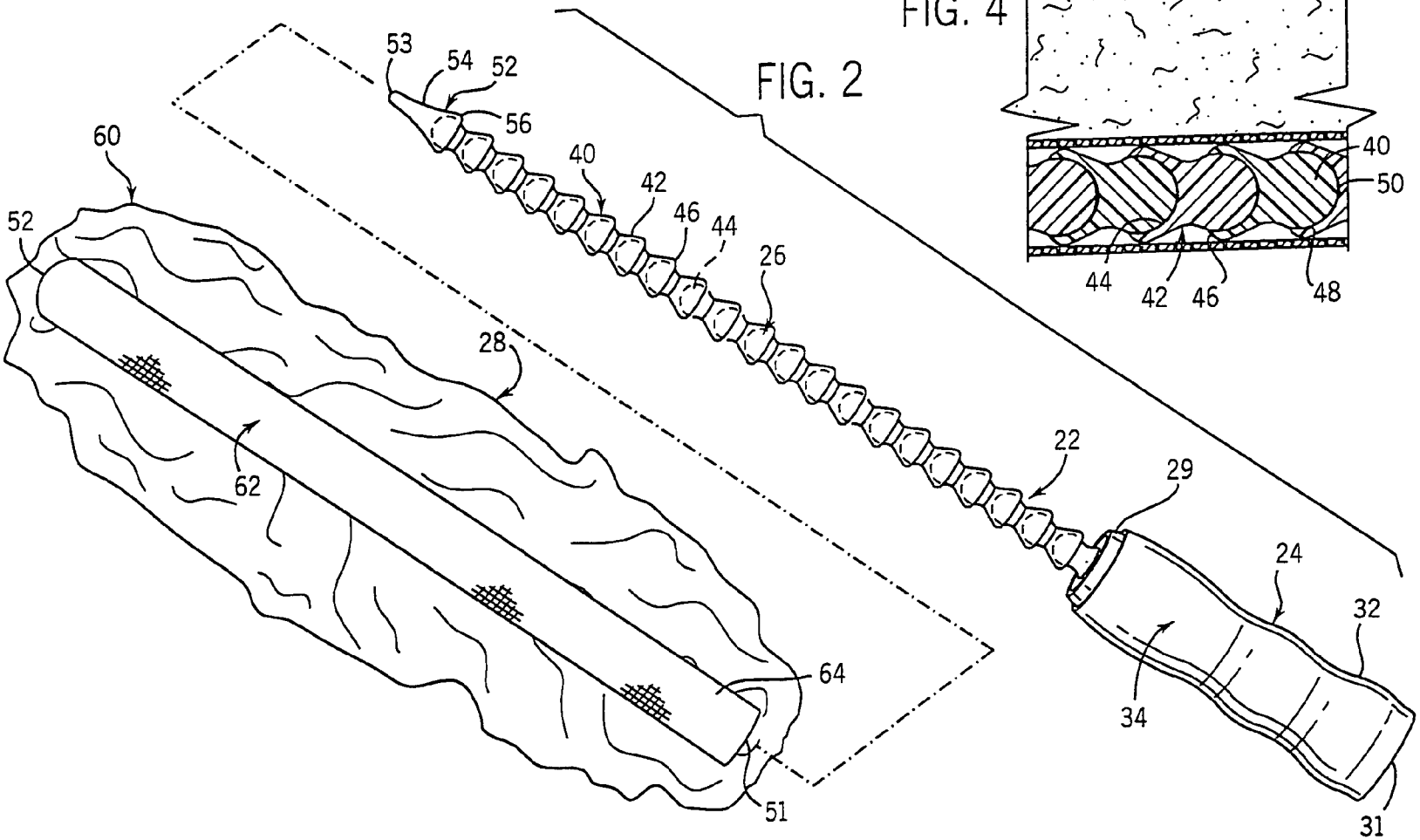
FIG. 2 is an exploded perspective view of the component parts of the cleaning device illustrated in FIG. 1.

Turning initially to FIGS. 1 and 2, the inventive cleaning system 20 is illustrated according to one preferred embodiment of the present invention. Cleaning system 20 is generally comprised of a cleaning device or tool 22, including a handle portion or handle 24 and attached flexible cleaning pad support, flexible support rod or flexible support member 26, and a cleaning pad or cleaning implement 28 attached to the cleaning tool 22 via the cleaning pad support member 26.

Handle portion 24 is preferably an ergonomically designed member configured to comfortably fit within the palm of a hand of a user. Handle portion 24 includes an integral forward cleaning pad support member connection surface 29, bottom 31, and ergonomic side 32. Handle portion 24 may be constructed from a variety of synthetic resins, plastics or other suitable materials. In the preferred embodiment, handle portion 24 includes a soft cover 34 for comfortable use by a user. The cover 34 may be made from foam, rubber or other known soft materials. Although the handle portion 24 may be constructed in a wide variety of sizes depending on the intended use, in the preferred embodiment, handle portion 24 is approximately 5.2 inches or 13.21 mm. long. The preferred dimensions allows for ease of use, manipulation, packaging, shipping and storage of the cleaning system 20 as well as increasing the overall ergonomics of the design. Handle portion 24 may be constructed in a variety of colors for increased aesthetic appeal. It may additionally be constructed from a translucent material. The handle portion 24 could also house an extension element for added reach or allow for the connection of an extension element.

Figure 5:
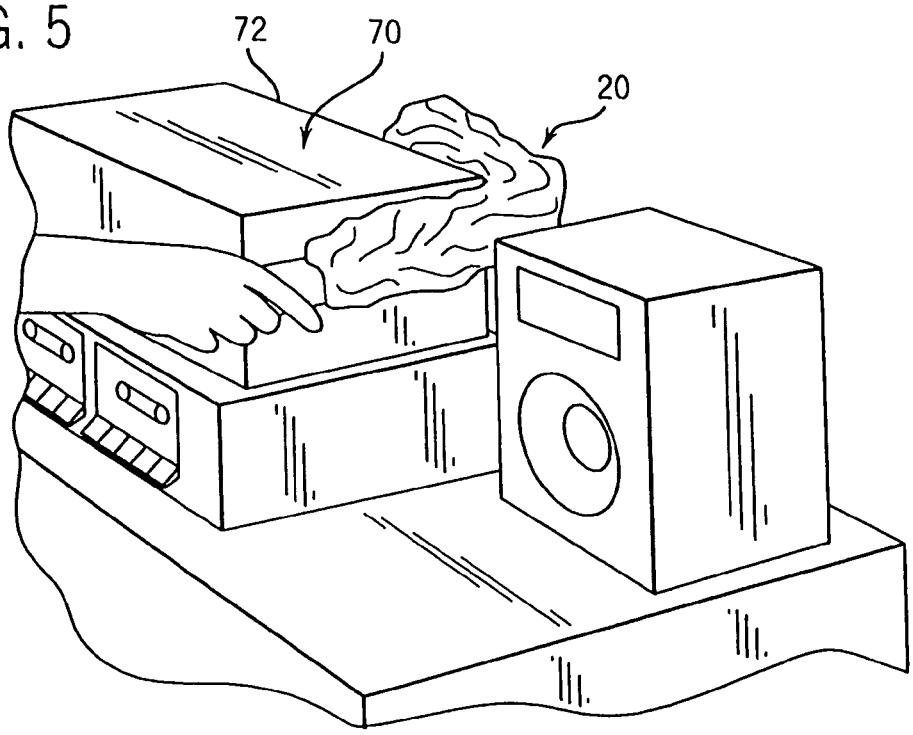
FIG. 5 is a perspective view of the cleaning device being used to clean behind a stereo.
Figure 6:
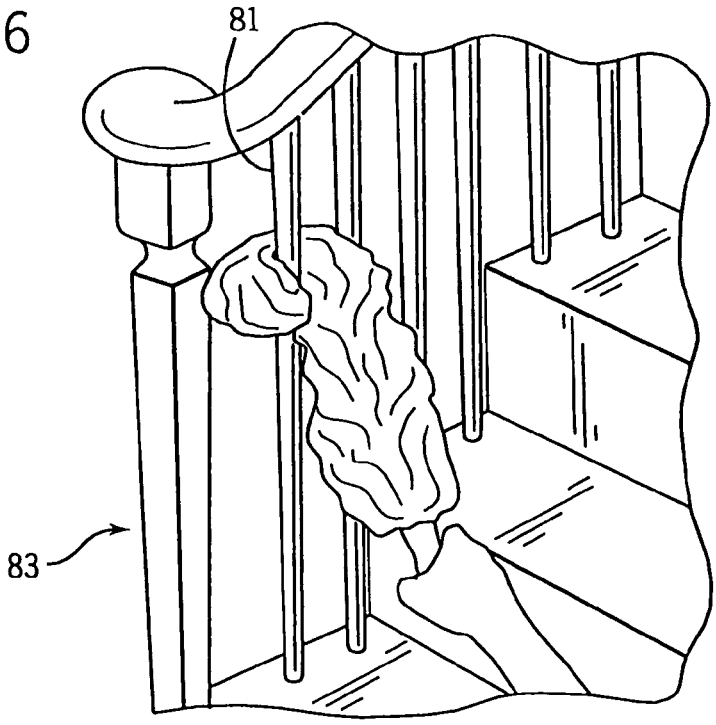
FIG. 6 is a perspective view of the cleaning device being used to clean a spindle of a staircase.

Attached to the handle portion 24 is the flexible cleaning pad support member 26. The flexible cleaning pad support member 26 may be attached to the handle portion 24 in a variety of conventional ways. The elongated flexible cleaning pad support member 26 is capable of being manually moved into a plurality of differing shapes while at the same time exhibiting enough strength to maintain its position during dusting or cleaning. As illustrated by FIGS. 5 and 6, such shapes include bending the flexible cleaning pad support member 26 to form a 90° angle, or wrapping a portion of the flexible cleaning pad support member 26 around a spindle or rod. A wide variety of other configurations may also be formed. The cleaning pad can be inserted from either end, enabling the user to make get the most utility out of the pad, since the portion furthest from the user often gets dirtiest fastest.

Figure 4:
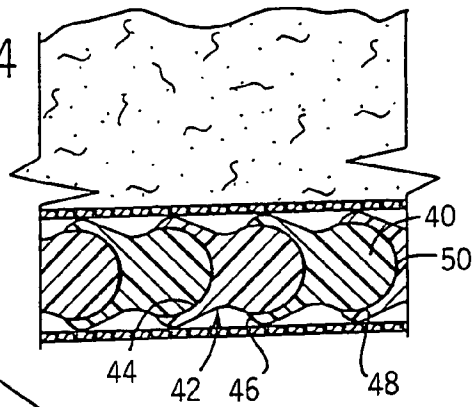
FIG. 4 is a sectional view taken along line 4-4 of FIG. 3.

In the illustrated preferred embodiment of FIGS. 2 and 4, the elongated flexible cleaning pad support member 26 has a retaining means of the type marketed by Lockwood Products, Inc. under the trade designation LOC-LINE. This product is typically used as a modular hose system for providing high volume fluids.

The elongated flexible cleaning pad support member 26 comprises a plurality of interconnected segments 40. Although the cleaning pad support member may be constructed in a wide variety of sizes depending on the intended use, in the preferred embodiment the elongated flexible cleaning pad support member 26 is approximately 12.5 inches, or 31.75 mm. long.

As illustrated in FIGS. 2 and 4, each segment 40 preferably comprises a central body portion 42, a male end portion 44 and a female end portion 46. The male end portion 44 has an outer surface 48 comprising a frustum of a sphere and the female end portion 46 has a mating inner surface 50 comprising a frustum of a sphere which is dimensioned so that, when the male end portion 44 is inserted into the female end portion 46, there is frictional contact between the mating male end portion outer surface 48 and female end portion inner surface 50. These frictional forces function as retaining means to hold one segment 40 at any desired location relative to an interconnected segment 40. However, these frictional forces can be overcome, and thus permitting interconnected segments 40 to be moved relative to each other so that their longitudinal axes are either in or out of alignment. This permits unrestricted relative rotational movement therebetween. Thus, the static friction holds the segments in place and is overcome when a user initially starts moving the segments. Once in motion, low dynamic friction that makes the segments 40 easy to move. This connection permits the attached cleaning pad 28 to have the same relative movements as the interconnected segments, as described above. The length of the elongated flexible cleaning pad support member 26 can be changed by adding or removing segments 30.

In one embodiment, the interconnected segments 30, closest the handle portion (e.g. extending about 6 inches, or 15.24 mm. from the handle portion) are stiffer than the remaining interconnected segments 30. This allows the tool to better hold its shape when used especially on flat surfaces. Otherwise the handle becomes perpendicular to the work surface, as opposed to a preferred use angle. In order to ensure such an effect, the first six inches of the segments 30 may be encased, for example, in rubber heat shrink tubing.

At the end of the flexible cleaning pad support member is a cone shaped end member 52. Cone shaped end member 52 includes a pointed tip 53 a central body portion 54, and a female end portion 56 configured to receive the male end portion 44 of a segment 40. The pointed tip 52 may include an aperture therein for the discharge of a cleaning solution in one embodiment of the design. As it can be appreciated from the attached figures, the entire design of the flexible support member 26 provides an exterior surface that makes it easy to slide the cleaning media over the cleaning support member onto the cleaning tool 22. Likewise, due to the outer edge of the female end portions 46, the cloth is retained onto the cleaning pad support during dusting.

Although not shown, it should be recognized that handle portion 24 and flexible cleaning pad support member 26 may define a fluid delivery passage. The handle portion 24 could house a liquid that could be selectively discharged from the flexible cleaning pad support member using a variety of known means. The fluid may be comprised of a variety of known products. Preferably the fluid is selected from the commercially available Pledge® Multi-Surface Cleaner, Pledge® Wood and Glass Cleaner, End Dust®, Fantastic® all purpose cleaner, Windex® glass cleaner, anti-bacterials such as Oust® or Lysol®, fragrances such as Glade®, leather or vinyl treatment such as Armor All®, fabric protectors such as Scotch Guard®, or fabric fresheners such as those manufactured by S.C. Johnson & Son, Inc. of Racine, Wis., or Febreze®. The fluid may alternatively generally comprise, without limitation: any all-purpose cleaner, oil or water based dust inhibitor, anti-static, anti-microbial, antibacterial, sanitizing and de-odorizing agent, dusting agent, glass cleaner, furniture polish, leather or vinyl treatment, other cleaning agent, wax, polish or shining agent, softening agent, friction-enhancing compound, perfumes, dish cleaner, soap, insect repellent or insect barrier, exfoliator or other personal care product, paint for sponge painting or other application, water out emulsions, oil out emulsions, dust mite killer or repellant, abrasive cleaner, shoe polish, pet sanitation products, etc.

Cleaning pad 28 is generally known in the art and comprised of a combination of fibers defining a cleaning surface 60 and attachment portion 62. Cleaning pad 28 may be comprised from a single cleaning pad or from multiple cleaning pads attached sequentially to cover the cleaning pad support member 26. The cleaning pad 28 may, for example, include a plurality of fluffed nonwoven fabrics made of synthetic resins, which may be welded to one another. The pad may include fibers constructed from PP, PE, PET fibers in a variety of alternative percentages by weight. In the illustrated embodiment, attachment portion 62 defines a pocket or sleeve 64 configured to tightly fit over support member 26. Attachment portion 62 may be constructed from an elastic material to snuggly fit over the support member 26. Although in the illustrated embodiment, sleeve 64 is illustrated as having an open end 51 and a closed end 52, it should be recognized that the sleeve 64 could have two open ends to allow the cleaning pad to be reversible and insertable on the support member 26 from either end. The reversibility of the cleaning pad 26 allows for maximum use of the cleaning pad. As it has been shown that during dusting the tip of the cleaning pad furthest from the handle 24 accumulates the most dust, the reversibility of the cleaning pad 26 allows for maximum usage of the cleaning surface 60 of the cleaning pad 26.

In the illustrated preferred embodiment, the cleaning pad 28 includes an elastic attachment portion 62. However, it is recognized that alternative configurations could be utilized to effectively retain the cleaning pad 28 on the support member 26. For example, Velcro® or rubber bands could be included on a segment of the attachment portion 62 in order to retain the cleaning pad on the cleaning pad support member 26. Other support structures or retaining features may also be used to retain the cleaning pad 28 on the support member 26.

Cleaning pad 28 is preferably, a 20 g/sqm spun lace cloth with between 1-4% mineral oil manufactured by Haso Corporation of Japan. Examples of such cleaning or dusting pads are described in PCT/JP2004/10507, the entirety of which is expressly incorporated by reference.

The cleaning surface 60 of cleaning pad 28 may be comprised of a polymer that allows for the spontaneous transport of aqueous fluids. Such polymers are described in, for example, U.S. Pat. Nos. 5,723,159, 5,972,505 and 5,200,248 the disclosures of which are expressly incorporated by reference.

It should be recognized that the polymer fibers of the cleaning pad can take a variety of forms to increase various performance characteristics of the cleaning system 20. Standard circular fibers may be used, as is generally known in the art. Alternatively, the individual fibers on the cleaning pad may be lobed in the form of loose tow fibers. The unique lobed configuration creates channels within the individual fibers enabling improved capillary action on each individual fiber and increasing the overall cleaning or dusting surface area and thereby increasing the overall efficiency of both wet and dry dusting. Higher surface area also results in an increase in the proportion of particles adhering in the grooves or channels and results in dust particles being "trapped" within the grooves of the lobed fiber. The lobed fibers not only generally exhibit improved dust retention, but also more efficient wet wiping characteristics and longer life than standard circular fibers. Furthermore, the lobed fibers can be made stiffer thereby generating a higher wiping pressure in a smaller contact area. It is understood that the inventive lobed fibers could be comprised of a multitude of polymers with PP, PE or PET being recognized as the most cost effective alternatives. Alternatively, acrylic or biodegradable polymers may also be utilized.

In another alternative embodiment, the cleaning pad 28 may include stiffer or strut fibers attached to mass of tow fibers. In this arrangement, the stiffer fibers (usually in the range of about 0.3 mm) carry the majority of the stress applied to the cleaning pad 28. The tow may be linked to the stronger fibers by entanglement at the outer ends of the fiber. The stiffer fibers result in a cleaning pad 28 that is springy resulting in a more desirable feel of applied force for users. The stiffer fibers may further be utilized to clean difficult areas such as crevices, blinds or screens. The stiffer fibers have the further advantage in that they keep the tow volume expanded, thereby increasing dust migration into the tow fibers.

In yet another alternative embodiment, the cleaning pad 28 could include absorbent materials in particulate form fixed onto the remaining fibers of the cleaning pad 28. The absorbent materials may take the form of known super absorbent polymers ("SAPs"). The SAPs may be, for example, acrylic based polymers applied as a coating or turned into fibers directly. Such commercially available SAPs generally include X-linked polyacrylic acids or X-linked starch-acrylic-acid-graft-polymers, the carboxyl groups of which are partially neutralized with sodium hydroxide or caustic potash. The SAPs may be made by such processes as a solvent or solution polymerization method or the inverse suspension or emulsion polymerization method. Such SAPs are disclosed in, for example, U.S. Pat. No. 6,124,391, which is hereby expressly incorporated by reference.

The above-mentioned absorbent materials increase the overall absorbency of the fibers, prevent the fibers from packing close together into a fiber mass, and enhance the friction of the fibers. In one embodiment, the "string of pearls" arrangement also allows for strategically placed high absorbency regions on the cleaning pad. For example, if it is desirable to have the forward end of the cleaning pad 28 be more absorbent than the remainder of the cleaning pad 28, the forward end could include a higher percentage of the particulate absorbent materials.

The cleaning pad 28 may also include fibers that are formed into helices. Such fibers may be formed by drawing fiber bundles over a blade or heating coaxial bicomponent fibers. The resulting helical fibers exhibit a fluffier texture and more attractive appearance while at the same time increasing the volume (while using less fiber) and dust retention of the duster. The helical nature of the fibers is also advantageous in that they allow coarse fibers to feel softer due to the spring effect. Furthermore, the fibers gradual loss of the helical nature, can serve as an indication of the effective life of the cleaning pad.

In one embodiment, the cleaning pad may be comprised of three component sheets or layers. Two sheets form the carrier or base and they are attached to a cleaning or wipe-off layer of nonwoven fibers. The two part carrier includes an outermost or top sheet forming the sleeve or pocket 64 configured to receive the flexible cleaning pad support member. Beneath the pocket is a second carrier sheet. The carrier layer includes a plurality of fringes or strips extending along its lateral sides.

Underneath the second carrier layer is the wipe-off layer. The wipe-off layer is comprised of tow fiber (loose nonwoven fibers). The tow is preferably a bi-component fiber consisting of a polypropylene core and a polyethylene outer surface. The three component layers may be bonded to each other by a central heat-seal line extending through the center of the three component layers. Along the opposed edges of the pocket layer, are a series of spot welds.

In another embodiment, a base carrier layer is bonded to the tow fibers via a central weld line and a series of spot welds running along the lateral sides of the cloth. The spot welds only bond the carrier sheet and the tow fiber. Two additional layers are attached to the base carrier layer to form the pocket or sleeve 64. The pocket layers are sealed with continuous heat seal lines extending between the two exterior pocket layers. The tow fiber is also bicomponent, but it consists of a polypropylene core and a polyester outer layer. In another preferred embodiment, polypropylene or nylon fibers are welded to the center of the tow fiber.

It should be recognized that none of the aforementioned fiber materials or configurations are exclusive. The cleaning pad could include strategic combinations of the various fibers and other known fibers. In one example, the cleaning pad may be comprised of between 25-100% of the lobed fibers by weight.

Similarly, although the preferred embodiment discloses a 360° uniform cleaning surface 62, the invention is in no way limited to such a single cleaning surface. To the contrary, numerous alternative configurations are within the scope of the present invention. For example, the inventive pad could include multiple cleaning surfaces, with alternate or similar fiber configurations to accommodate various cleaning functions. In one embodiment, a cleaning pad 28 could be two sided with one side of the cloth for dusting and the alternate side of the cleaning pad 28 for cleaning. This may also be accomplished by turning the pad "inside out" to expose a new clean surface. Alternatively, a triangular or other multi-sided cleaning pad 28 could be utilized. In general, a variety of cleaning pad 28 shapes or configuration may be utilized to maximize the various properties of the cleaning pad 28 and selected fibers.

As noted above, the orientation and type of fibers utilized on the cleaning pad 28 could include a wide variety of alternatives. For example and in no way limiting, the cleaning pad 28 may include a generally fluffy pad including a flat center strip around the area defined by the pockets or sleeves 64. Such an orientation may increase the surface area and exhibit a better efficacy. Additionally, the center strip could include an absorbent pillow or tube extending down the center of the cleaning pad 28. Such an absorbent pillow could provide an area of high absorbency on the cleaning pad 28. Various alternative combinations are envisioned including, for example, cleaning pads consisting of alternating sections of sponges, feather-like structures, scrubbing pads, micro-fibers or cellulose foam. Wood pulp is preferred.

The cleaning pad 28 could also include a fluffy cloth with a hydrophilic additive to improve the absorbency of water. Such hydrophilic additives include but are not limited to glycerin and glycols. The cleaning pad 28 could also be comprised entirely of an absorbent material such as Rayon.

The cleaning pad 28 or cleaning pad support member 26 could also include a piezoelectric crystal to impart an electrostatic charge on the cleaning pad during use to increase dust retention. Such crystals are generally known and typically generate a charge when subjected to mechanical stress. Examples of materials that can be used include but are not limited to quartz analogue crystals like berlinite ($AlPO_4$) and gallium orthophosphate ($GaPO_4$), ceramics with perovskite or tungsten-bronze structures ($BaTiO_3$, $KNbO_3$, $LiNbO_3$, $LiTaO_3$, $BiFeO_3$, $Na_xWO_3$, $Ba_2NaNb_5O_5$, $Pb_2KNb_5O_{15}$). Additionally some Polymer materials like rubber, wool, hair, wood fiber, and silk exhibit piezoelectricity to some extent and may be utilized. Additionally, the polymer polyvinylidene fluoride, (—$CH_2$—$CF_2$—), which exhibits piezoelectricity several times larger than quartz may be used.

The cleaning pad 28 may also include a portion of an unbonded web material, as described in U.S. Pat. Nos. 5,858,112, issued Jan. 12, 1999 to Stokes et al. and 5,962,112, issued Oct. 5, 1999 to Haynes et al. or other material such as described by U.S. Pat. No. 4,720,415, issued Jan. 19, 1988 to Vander Wielan et al. or any super absorbent material such as described in U.S. Pat. Nos. 4,995,133, issued February 1991 and 5,638,569 both issued to Newell, 5,960,508, issued Oct. 5, 1999 to Holt et al., and 6,003,191, issued Dec. 21, 1999 to Sherry et al., all of which are hereby expressly incorporated by reference herein.

In one embodiment, the cleaning pad 28 may comprise a spunbound fiber nonwoven web having a basis weight of approximately 68 grams per square meter. The spunbound fibers may comprise bicomponent fibers having a side-by-side configuration where each component comprises about 50%, by volume, of the fiber. The spunbound fibers will comprise first and second polypropylene components and/or a first component comprising polypropylene and a second component comprising propylene-ethylene copolymer. About 1% or more or less of titanium oxide or dioxide is added to the fiber(s) in order to improve fiber opacity. The spunbound fiber nonwoven web is thermally bonded with a point unbonded pattern. The nonwoven web is bonded using both heat and compacting pressure by feeding the nonwoven web through a nip formed by a pair of counter-rotating bonding rolls. The bonding rolls comprise one flat roll and one engraved roll. The bonded region of the nonwoven web comprises a continuous pattern that corresponds to the pattern imparted to the engraved roll. Further, the bonded region is applied to the web when it passes through the nip. The bonded region will range between approximately about 27% to about 35% of the area of the nonwoven web and forms a repeating, non-random pattern of circular unbonded regions. Other absorbency enhancing or superabsorbent materials, including superabsorbent polymers, powders, fibers and the like may be combined with the cleaning pad 28.

Alternatively, the pad 28 may comprise a laminate of an air-laid composite and a spunbound fiber nonwoven web. The nonwoven web may comprise monocomponent spunbound fibers of polypropylene having a basis weight of approximately 14 grams per square meter. The air-laid composite may comprises from about 85% to about 90% kraft pulp fluff and from about 10% to about 15% bicomponent staple fibers. The bicomponent staple fibers may have a sheath-core configuration; the core component comprising polyethylene terephthalate and the sheath component comprising polyethylene. The air-laid composite has a basis weight between about 200 and about 350 grams per square meter and an absorbency of between about 8 and about 11 grams per gram.

The cleaning pad 28 may also include a portion or side of hydrophilic fibers useful for scrubbing. Additionally, nylon fibers may be used to increase the coefficient of friction when they become wet. Portions of the cleaning pad 28 may be composed of microfibers and ultra-microfibers having a denier per filament (dpf) less than or equal to about 1.0.

As described, the cleaning pad 28 can be formed by any material or material-forming process known, including woven and non-woven materials, polymers, gels, extruded materials, laminates, layered materials which are bonded together integrally and thus form a co-material, fused materials, extruded materials, air laying, etc.

The cleaning pad 28 can alternatively be optimized for providing a cleaning fluid to the surface, such as with micro capsules or encapsulated fluids or agents. The enhanced surface of the cleaning pad 28 can have scrubbing or abrasive qualities. The enhanced surface can also be formed by a mechanical stamping, bonding, pressing, compression, extrusion, sprayed, sputtered, laminated or other surface forming or affecting process. The various alternative solutions discussed above could be microencapsulated into the cleaning pad such that they are selectively released by some additional stimulus, e.g., activated by water, another chemical in the fluid reservoir or pressure. The solutions could also be dry impregnated. Alternatively, the chemical solutions could be encapsulated in pockets or bubbles on or within the pad 28 or on the cleaning pad support member 26. For example, these pockets could be designed to burst and release the cleaning solution upon the application of moderate pressure.

FIGS. 1, 5 and 6 illustrate the inventive cleaning system in alternating but non-limiting positions. FIG. 5 illustrates the cleaning system 20 in a cleaning position suitable for cleaning behind appliances such as a stereo 70. As illustrated in FIG. 6, the flexible cleaning pad support 26 maybe bent at an angle of about 90° in relation to the handle portion 24, such that a user can dust the back surface 72 of the stereo without moving the stereo 70 or any of its component parts. In order to form the 90° angle, a user simply bends the flexible cleaning pad support member 26 at a desired junction. Thus, in the cleaning position, a user may manipulate the cleaning system 20 via the handle portion 24.

FIG. 6 illustrates the cleaning system 20 in a second hook-like cleaning position suitable for cleaning or dusting circular features such as the spindle 81 of a staircase 83. In order to move the cleaning pad support member 26 from the first position illustrated in FIG. 5 to the position in FIG. 6, a user preferably holds the handle portion 24 and applies torque to the flexible cleaning pad support member 26 to move it from the cleaning position illustrated in FIG. 1 to the curved orientation illustrated in FIG. 6. As sufficient torque is applied to overcome the forces of the flexible support member, the support member rotates downwardly into the position illustrated in FIG. 6. FIG. 1 illustrates the cleaning system in yet another alternative cleaning position. In FIG. 1, the cleaning pad support member is straight and in substantial alignment with the axis of the handle portion 24. This cleaning position is suitable for the cleaning of large surfaces such as a dining room table. During dusting or cleaning, a user may repeatedly rotate the cleaning pad support member to any variety of cleaning positions as needed.

Figure 11:
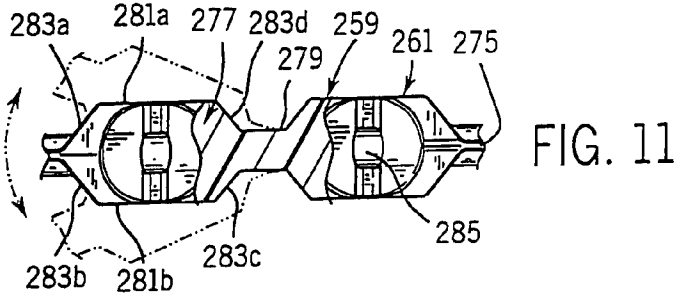
FIG. 11 is a magnified partial cross-sectional view of the cleaning pad support taken along line 11-11 of FIG. 8 illustrating the insert molded wire spine.
Figure 12:
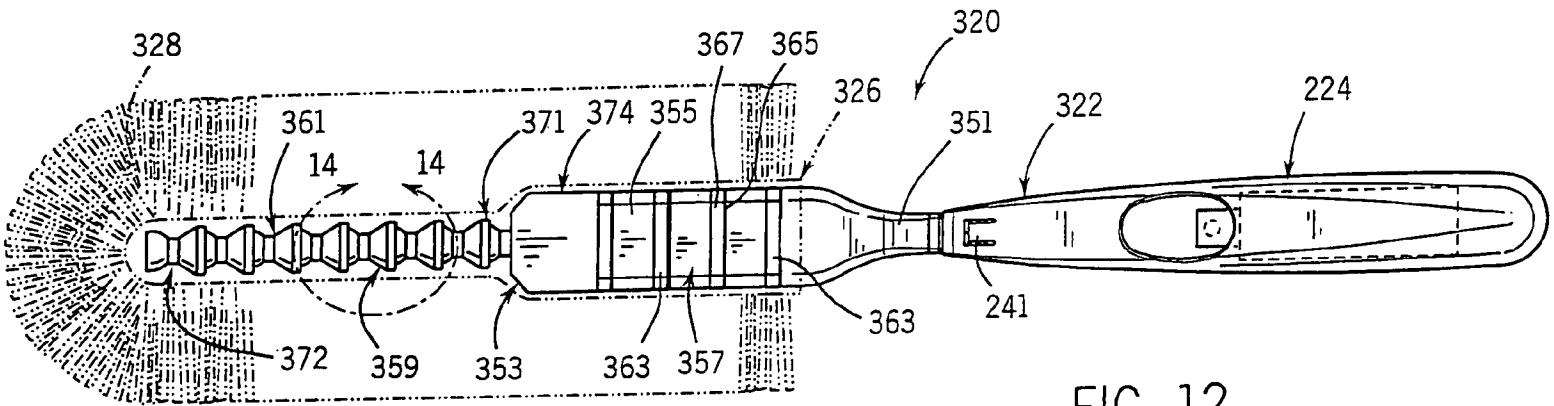
FIG. 12 is a top plan view of a third embodiment of an assembled flexible cleaning device illustrating a pivotable handle having a cleaning fluid reservoir receiving cradle attached to an alternative cleaning pad support member.
Figure 13:
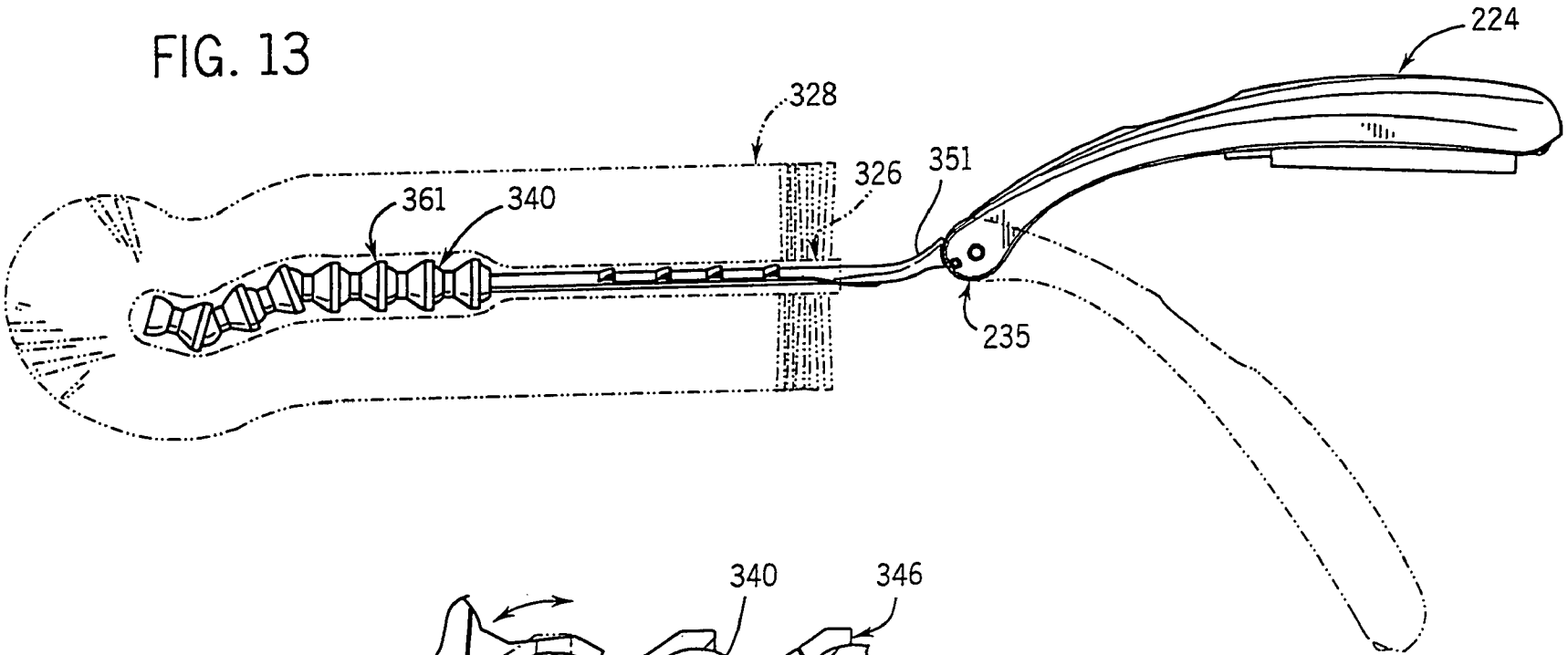
FIG. 13 is a side view of the flexible cleaning device illustrated in FIG. 12 illustrating a liquid application position in phantom.
Figure 14:
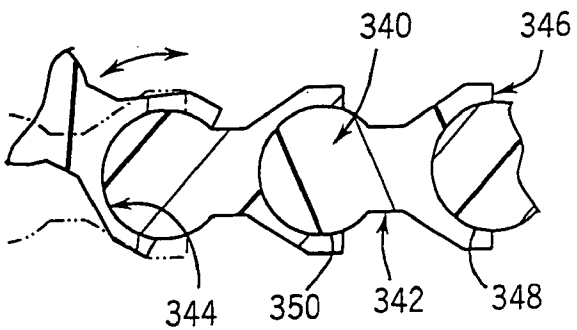
FIG. 14 is a magnified cross-sectional view of part of the cleaning device taken along line 14-14 of FIG. 12 illustrating an alternative cleaning head support.

FIGS. 7-11 illustrate a second embodiment of the preferred cleaning system and FIGS. 12-14 illustrate a third embodiment of the preferred cleaning system. As will become apparent from the description that follows, the cleaning systems illustrated in FIGS. 7-14 are designed for use in wet, damp or dry cleaning and include a fluid reservoir or liquid delivery system within a pivotally attached handle. The cleaning system allows for fluid application directly to a cleaning pad or to a surface to be cleaned. The alternative embodiments of the cleaning system preferably include a cleaning tool that includes a handle defining a fluid reservoir receiving cradle and a pivotally attached cleaning pad support member. In addition to the benefits of the flexible duster previously described, this results in a single hand operated tool that provides options for wet, damp or dry cleaning not available in traditional cleaning devices. One should note that the handle and reservoir shown in, e.g., FIGS. 7-11, could be combined with the support 26 of, e.g., FIG. 1 for yet another embodiment.

FIGS. 7-11 illustrate a second embodiment of the preferred cleaning system 220. Cleaning system 220 is generally comprised of a cleaning device or tool 222, including a handle portion or handle 224 pivotally or moveably attached to a flexible cleaning pad support member, cleaning pad support, flexible support rod or flexible support member 226, and a cleaning pad or cleaning implement 228 attached to the cleaning tool 222 via the cleaning pad support member 226.

As illustrated by FIGS. 7-11, handle portion 224 is preferably a curved ergonomically designed member configured to comfortably fit within the palm of a hand of a user. Handle portion 224 includes an integral top 223, first sidewall 225*a*, second sidewall 225*b*, rear wall 227 and bottom. Handle portion 224 may be constructed from a variety of synthetic resins, plastics or other suitable materials. In the preferred embodiment, handle portion 224 is constructed from polypropylene. Although the handle portion 224 may be constructed in a wide variety of sizes depending on the intended use, in the preferred embodiment, handle portion 224 is approximately 8.5 inches long, 1.3 inches wide and 1.7 inches high. These preferred dimensions allow for ease of use, manipulation, packaging, shipping and storage of the cleaning system 220 as well as increasing the overall ergonomics of the design. Handle portion 224 may be constructed in a variety of colors for increased aesthetic appeal. It may additionally be constructed from a translucent material.

As will be described in greater detail below, handle portion 224 defines a fluid reservoir-receiving cradle, recess or bay 231. In the preferred embodiment, the insertion of the fluid dispenser or reservoir 233 into the cradle 231 finishes the ergonomic design or form of the handle portion 224. Thus, the palm of a user's hand extends over the top 223 handle portion 224 and the user's fingers extend at least partially around the fluid reservoir 233. Additionally, the preferred curved ergonomic design of the handle portion 224 is constructed in a manner such that the pivot point defined by the pivot member receiving cavity 235 is located below the horizontal plane defined by the fluid reservoir 233 within the cradle 231. Such an orientation is advantageous in maximizing fluid application as discussed in greater detail below.

Figure 7:
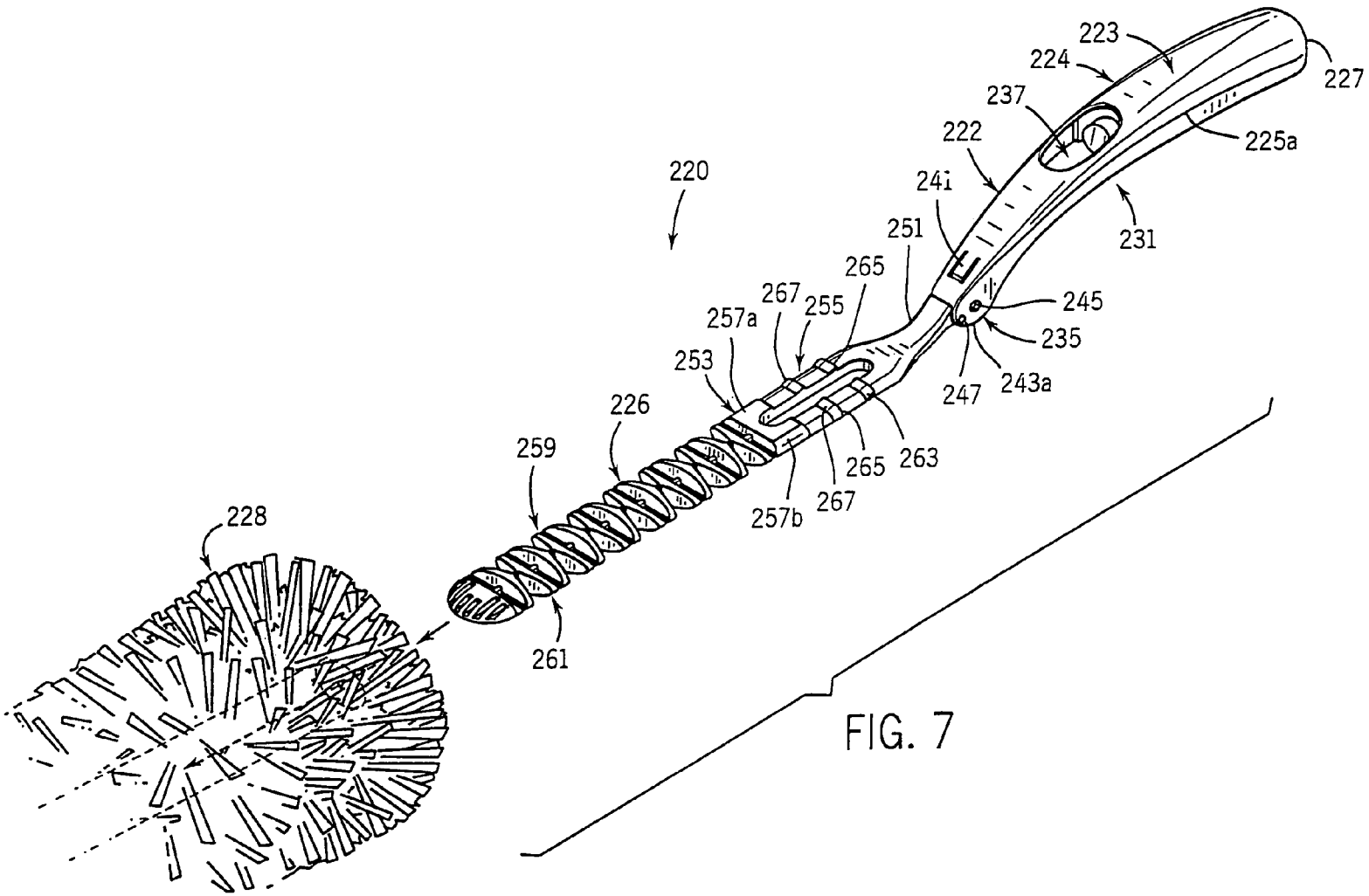
FIG. 7 is a perspective view of a second embodiment of a partially assembled flexible cleaning device illustrating a pivotable handle with cleaning fluid reservoir receiving cradle attached to an alternative cleaning pad support member.

Near the center of the handle portion 224 is an opening or hole 237 extending through handle portion 224 into the bottom of the handle portion. In the illustrated embodiment, opening 237 is approximately 2.5 inches, or 6.5 mm. from a pivot member receiving cavity 235 located at the forward end of the handle portion 324. As illustrated in FIG. 7, opening 237 provides a user single-handed access into a fluid reservoir-receiving cradle, recess or bay 231 defined in the bottom of the handle portion 224. Near the forward end of the handle portion 224, above the pivot member receiving cavity 235 is a cantilevered pivot engagement tab 241, extending downwardly into the pivot member receiving cavity 235 described in greater detail below.

FIGS. 7, 8, 9, and 13 illustrate one preferred embodiment of a fluid reservoir 233 of the cleaning system 220. In the illustrated embodiment, fluid reservoir 233 is in the form of a fluid dispenser or a pump-activated spray bottle configured to retain water or a specialized fluid. The fluid may generally comprise, without limitation: any all-purpose cleaner, oil or water based dust inhibitor, anti-static, anti-microbial, anti-bacterial, sanitizing and de-odorizing agent, dusting agent, glass cleaner, furniture polish, leather or vinyl treatment, other cleaning agent, wax, polish or shining agent, softening agent, friction-enhancing compound, perfumes, dish cleaner, soap, insect repellent or insect barrier, exfoliator or other personal care product, paint for sponge painting or other application, water out emulsions, oil out emulsions, dust mite killer or repellant, abrasive cleaner, shoe polish, pet sanitation products, etc. known products. Known products include commercially available Pledge® Multi-Surface Cleaner, Pledge® Wood and Glass Cleaner, End Dust®, Fantastic® all purpose cleaner, Windex® glass cleaner, anti-bacterials such as Oust® or Lysol®, fragrances such as Glade®, leather or vinyl treatment such as Armor All®, fabric protectors such as Scotch Guard®, or fabric fresheners such as those manufactured by S.C. Johnson & Son, Inc. of Racine, Wis., or Febreze®.

The preferred spray bottle is a generally cylindrical bottle having an integral bottom, sidewall, second and third sections as disclosed in U.S. patent application Ser. No. 11/045,204, filed Jan. 28, 2005 and incorporated by reference herein. As best described in U.S. patent application Ser. No. 11/045,204, a spray cap or nozzle is screwed or press fitted onto the top of the spray bottle. The spray cap includes a pair of opposed flats configured to selectively engage flanges of the fluid reservoir-receiving cradle 231. Alternatively, a system of tabs and grooves could be used to form a similar locking mechanism. The spray cap could alternatively include a one sided flat button or a tapered button. In addition, the fluid reservoir 233 could take a variety of forms including but not limited to an aerosol package, a deformable handle or reservoir that dispenses fluid by squeezing, a squirt gun or a flexible pouch with an attachable spray nozzle. While the fluid reservoir 233 is illustrated as fitting within the cradle 231 of the handle portion 224, the fluid reservoir 233 may alternatively completely form the handle of the system, having only the upper portion of the cleaning system attached (i.e. the pivot member and the attachment members).

As best described in U.S. patent application Ser. No. 11/045,204, opposed flats of the spray cap can be used to provide for a tight fit within the handle portion 224, and further serve to properly orientate the fluid reservoir 233 within the cleaning system 220. Alternatively, it is understood that the fluid reservoir 233 could include other uniquely designed contours that allow for a mating tight fit within the fluid reservoir-receiving cradle 231.

U.S. patent application Ser. No. 11/045,204 illustrates one preferred embodiment of the fluid reservoir-receiving cradle 231 configured to retain the fluid reservoir 233. Cradle 231 is generally defined by a lower support, handle portion sidewalls and two U-shaped supports or rails and configured to receive the fluid reservoir 233 of the preferred embodiment. In the preferred embodiment illustrated in U.S. patent application Ser. No. 11/045,204, the lower support is comprised of a plurality of ribs extending from the inner side of rear wall of handle portion 224. The forward ends of the ribs define the lower support configured to support the bottom 245 of the fluid reservoir 233. In the preferred embodiment, ribs include a central rib having a length roughly equal to diameter of the bottom of the fluid reservoir 233. The remaining ribs define progressively shorter lengths, thereby tapering off from the central rib and supporting the remainder of the circular bottom of the fluid reservoir. A pair of triangular retention tabs extend along opposed sides of the cradle 231 near the lower support. The retention tabs are configured to frictionally engage and retain the lower sidewall of the fluid reservoir 233. Extending forwardly from the retention tabs, the sidewalls of the cradle further define the sides of the fluid reservoir-receiving cradle 231 and are spaced in a manner to tightly fit around the sidewall of the fluid reservoir 233.

While in the illustrated preferred embodiment shown in the present application and in U.S. patent application Ser. No. 11/045,204, the fluid reservoir 231 is press fit or friction fit within the cradle 233 of the handle portion 224, it is recognized that alternative configurations could be utilized to retain the fluid reservoir 231 within the handle portion 224. For example, Velcro® or rubber bands could be included on a segment of the handle portion 224 in order to retain the fluid reservoir 231 within the handle portion 224. Other support structures or retaining features could be hingedly or otherwise attached to the handle portion 224 to retain the fluid reservoir 231 within the handle portion 224.

As illustrated in U.S. patent application Ser. No. 11/045,204, near the forward end of the fluid reservoir-receiving cradle 233 is a first U-shaped bottleneck receiving support. First bottleneck receiving support is configured to press fit around, receive and retain the fluid reservoir of the preferred embodiment. First bottleneck receiving support is configured to press fit around the fluid reservoir near the junction of the second and third sections of the reservoir.

Slightly forward of the first bottleneck receiving support is a second U-shaped spray cap receiving support. Spray cap receiving support is configured to press fit around, retain and orientate the spray cap of the fluid reservoir. Spray cap receiving support is defined by a pair of flanges extending from the inner side of opposed sidewalls. The flanges are configured to press fit around flats of fluid reservoir spray cap when the reservoir is placed within the cradle 233. The tight fit defined by flanges and flats serves to properly orientate spray cap within the fluid reservoir-receiving cradle 231 such that the spray cap faces in a direction away from the cradle 231. Forward of the opening 237, are a plurality of structural support ribs extending forwardly towards the pivot member receiving cavity 235.

As best illustrated in FIGS. 6 and 11 of U.S. patent application Ser. No. 11/045,204, at the forward end of the bottom of the handle portion 224 is a pivot member receiving cavity 235. Pivot member receiving cavity 235 is defined between integral opposed ears 243*a*, 243*b* located at the forward end of the handle portion 224. Ears 243*a*, 243*b* include opposed grooves on their inner cavity surface configured to slidably engage the axles of a circular pivot member during assembly. Grooves have a width that is equal to or slightly wider than the diameter of the axles of the circular pivot member. It is understood that grooves and the pivot member receiving cavity 235 are configured to accommodate a variety of alternative cleaning pad support members 226 or other cleaning implements having pivot members attached at their proximal ends.

At the terminal end of the grooves, are pivot holes 245 configured to receive the axles of the circular pivot member and allow pivotable motion therein. A curved slot extends laterally from grooves and defines a passage configured to allow the movement of circular pivot retention tabs extending from the pivot member. On opposed sides of the forward end of the pivot member receiving cavity 235 are circular pivot retention tab holes 247 configured to engage and receive the circular pivot retention tabs located on the pivot member.

As best illustrated in U.S. patent application Ser. No. 11/045,204, projecting downwardly from the top 223 of the handle portion 224 into the pivot member receiving cavity 235 is a resiliently biased semi-flexible pivot engagement tab 241. Engagement tab 241 is comprised of a first end attached to the handle portion 224 and a second free end configured to engage notches on the outer surface of the pivot member.

Turning now to FIG. 7 of the present application, attached within the pivot member receiving cavity 235 of the handle portion 224 is the cleaning pad support member 226. Cleaning pad support member 226 is comprised of an integral circular pivot member (not shown), linking section 251 and a two part support head generally designated 253. As best illustrated in U.S. patent application Ser. No. 11/045,204, circular pivot member includes integral axles on its opposed lateral sides. The axles are configured to fit within pivot holes 245 and rotatably pivot therein. Pivot member also includes a circular pivot retention tab. Circular retention tab is configured to fit within retention tab holes 247 and support the system is in the cleaning position. The pivot member defines three notches or indentations corresponding to alternative positions of the cleaning pad support member 226. A cleaning position notch, liquid application notch and storage position notch are defined on the external surface of the pivot member. In general, the preferred pivot assembly requires about between 2-3 lbf of pivot force in order to rotate it.

Figure 8:
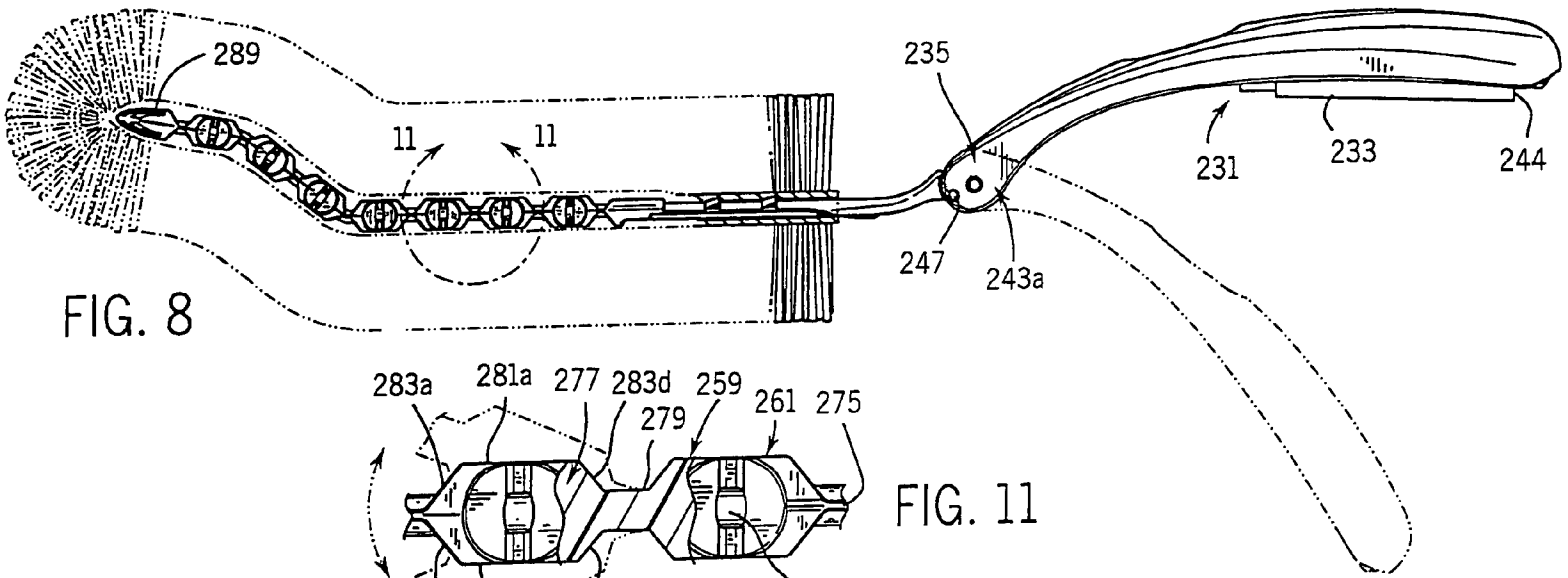
FIG. 8 is a side view of the flexible cleaning device illustrated in FIG. 7 illustrating a liquid application position in phantom.
Figure 9:
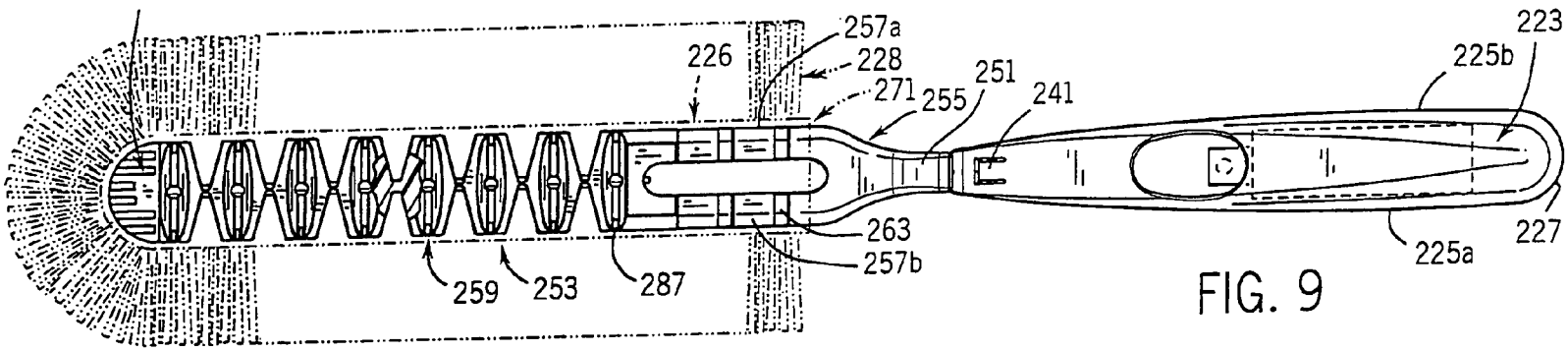
FIG. 9 is a top plan view of the flexible cleaning device illustrated in FIG. 7 with the attached cleaning pad shown in phantom.
Figure 10:
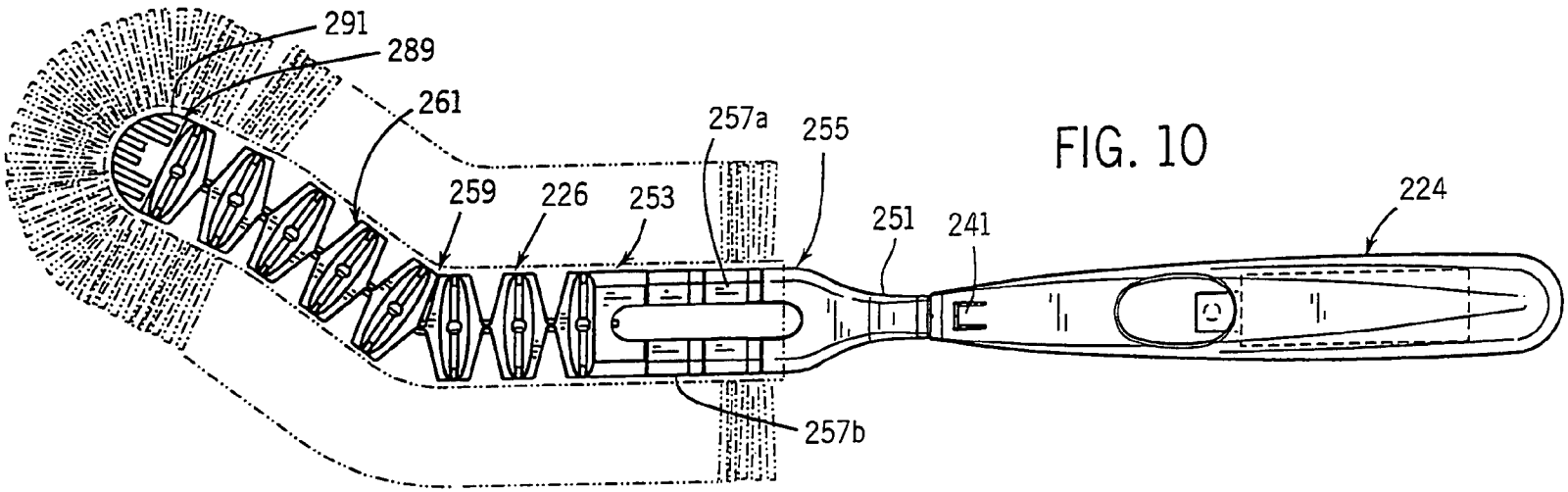
FIG. 10 is a top plan view of the flexible cleaning device illustrated in FIG. 7 with the attached cleaning pad shown in phantom illustrating the cleaning pad support member in an angled position.

Integral with and extending from the pivot member is the linking section 251 and two part support head 253. In the preferred embodiment, the two part support head 253 of cleaning pad support member 226 includes a semi-rigid first part 255 comprised of a pair of parallel attachment members 257*a*, 257*b*, and a flexible second part 259 comprised of an insert molded wire spine 261. As illustrated in FIGS. 8-10, both the first part 255 and second part 259 are configured to engage a pocket or sleeve 271 (shown in phantom) of a cleaning pad 228 as is generally known in the art. Attachment members 257*a*, 257*b* may be spaced apart in a variety of configurations, however, in the preferred embodiment, attachment members 257*a*, 257*b* have a total width of about 1.25 inches, or 3.18 mm. from opposed outside lateral edges. The preferred attachment members 257*a*, 257*b* are about 0.75 inches, or 1.91 mm. thick and about 0.80 inches, or 2.03 mm. wide. It is recognized that although the preferred embodiment illustrates a pair of attachment members 257*a*, 257*b* multiple configurations may be utilized. For example, a single, wider attachment member could be utilized as shown for e.g. in the third embodiment illustrated in FIGS. 12 and 13. Alternatively, three or more attachment members could be utilized.

Attachment members 257*a*, 257*b* include a plurality of spaced cleaning pad retaining tabs, barbs or projections 263 projecting from their upper surface. In the illustrated embodiment, retaining tabs 263 are triangular-shaped tabs having a first wall 265 extending in a generally vertical direction from the upper surface of the attachment members 257*a*, 257*b* and a second angled wall 267 sloping from the upper edge of the first wall 265 towards the distal end of the attachment members 257*a*, 257*b*. Tabs 263 are preferably raised about 0.05 inches, or 0.13 mm. from the attachment members 257*a*, 257*b*. The unique triangular configuration of the retaining tabs 253 serves a dual function. The angled wall 267 allows for ease of placement of the cleaning pad 228 on the attachment members 257*a*, 257*b* during assembly, while the vertical first wall 265 retains the cleaning pad 228 on the attachment members 257*a*, 257*b* during the cleaning motion.

In addition to the unique configuration of the retaining tabs 263, their orientation on the attachment members 257*a*, 257*b* also serves to maintain the cleaning pad 228 on the attachment members 257*a*, 257*b*. In one embodiment, the attachment members 257*a*, 257*b* may be expandable, inflatable, partially inflatable, or include an inflatable portion. The inflatability provides for an improved fit of the cleaning pad 228 on the attachment members 257*a*, 257*b* as well as facilitating hands free removal of the cleaning pad 228 from the attachment members 257*a*, 257*b*.

As illustrated in FIGS. 7-11, the second part 259 of the cleaning pad support member 226 includes molded living hinges preferably with a wire traversing defining an insert molded wire-like spine 261. Preferably, a piece of wire 275 is insert-molded into a plurality of polymer spine vertabrae 277 to form the wire spine 261. The wire 275 is retained only at the first vertebra 287 in the spine 261 and floats through the remaining part of the spine 261, allowing the spine 261 to bend easily. A variety of known materials could be used for the wire 275 including Bx cable or other known wires or flexible materials.

Although it is recognized that the components of the wire spine 261 could take a variety of shapes, in the illustrated embodiment, the wire spine includes a plurality of hingedly connected hexagonally-shaped support vertebrae 277 interconnected by bridge portions 279. The hexagonally shaped vertebrae 277 include parallel outer sides 281*a*, 281*b* and four angled walls 283*a-d* connecting each individual vertebra 277 with the bridge portions 279. Preferably, the outer sides 281*a*, 281*b* of the hexagonal vertebrae are spaced apart a distance that generally corresponds to the width of the pocket or sleeve 271 of the cleaning pad 228 such that a tight fit of the cleaning pad 228 on the cleaning pad support member 226 can be achieved. The center of each vertebra 277 includes a circular opening 285 through which the coated wire 275 passes.

The wire spine 261 preferably includes a first vertebra 287 connected to or integral with the first part 255 of the cleaning pad support member 226. In addition, a terminal vertebra 289 is located at the distal end of the wire spine 261 opposite the first vertebra 287. The terminal vertebrae 289 preferably includes a rounded tip 291 that also allows for ease of insertion of the cleaning pad 228 on the cleaning pad support member 226. In the illustrated embodiment, terminal vertebrae 289 includes a plurality of slots or grooves 293.

The second embodiment illustrated in FIGS. 7-11 provides a flexible cleaning pad support member 226 that is light enough for the user to bend easily, but stiff enough to retain its shape while in use. Insert-molding the wire 275 prevents the wire 275 from kinking as it would if it were not insert-molded and just naked. The wire 275 is retained only at one end in the spine and floats through the remaining part of the spine, allowing the spine to bend easily.

FIGS. 12-14 illustrate a third embodiment of the preferred cleaning system 320. Cleaning system 320 is generally comprised of a cleaning device or tool 322, including a handle portion or handle 224 pivotally or moveably attached to a flexible cleaning pad support member, flexible support rod or flexible support member 326, and a cleaning pad or cleaning implement 328 attached to the cleaning tool 322 via the cleaning pad support member 226.

It should be apparent for the drawings that the third embodiment includes an identical handle portion 224 defining a fluid reservoir-receiving cradle, recess or bay 231, for receiving a fluid dispenser or reservoir 233 to that described in reference to FIGS. 7-11 and therefore the details of those parts need not be described and will be referred to using like reference numerals.

Turning now to FIG. 12 of the present application, attached within the pivot member receiving cavity 235 of the handle portion 224 is the cleaning pad support member 326. Cleaning pad support member 326 is comprised of an integral circular pivot member (not shown); linking section 351 and a two part support head generally designated 353.

In the illustrated embodiment, the two part support head 353 of cleaning pad support member 326 includes a first part 355 comprised of a single widened semi-rigid attachment member 357, and a second part 359 defining a flexible spine 361.

As illustrated in FIGS. 12-13, both the first part 355 and second part 359 are configured to engage a pocket or sleeve 371 (shown in phantom) of a cleaning pad 328 as is generally known in the art. Sleeve 371 defines a narrower portion 372 configured to receive the second part 359 of the cleaning pad support member 326 and a wider portion 374 configured to receive the first part 355 of the cleaning pad support member 326.

Attachment member 357 is preferably constructed from a semi-rigid material similar to that used to construct the handle. Preferably the attachment member 357 has a total width of about 1.25 inches, or 3.18 mm. from opposed outside lateral edges. The preferred attachment member is about 0.75 inches, or 1.191 mm. thick. Attachment member 357 includes a plurality of spaced cleaning pad retaining tabs, barbs or projections 363 projecting from its upper surface. In the illustrated embodiment, retaining tabs 363 are triangular-shaped tabs having a first wall 365 extending in a generally vertical direction from the upper surface of the attachment member 357 and a second angled wall 367 sloping from the upper edge of the first wall 365 towards the distal end of the attachment member 357. Tabs 363 are preferably raised about 0.050 inches, or 0.13 mm. from the attachment member 357.

As illustrated in FIGS. 12-14, the second part 359 includes a flexible spine 361 similar to that described in the embodiment shown in FIGS. 1-6. The flexible spine 361 may be attached to the attachment member 357 in a variety of conventional ways. The elongated flexible spine 361 is capable of being manually moved into a plurality of differing shapes while at the same time exhibiting enough strength to maintain its position during dusting or cleaning.

In the embodiment illustrated in FIGS. 12-14, the elongated flexible spine 361 is of the type marketed by Lockwood Products, Inc. under the trade designation LOC-LINE. The elongated flexible spine 361 comprises a plurality of interconnected segments 340.

As illustrated in FIGS. 12-14, each segment 340 comprises a central body portion 342, a male end portion 344 and a female end portion 346. The male end portion 344 has an outer surface 348 comprising a frustum of a sphere and the female end portion 346 has a mating inner surface 350 comprising a frustum of a sphere which is dimensioned so that, when the male end portion 344 is inserted into the female end portion 346, there is frictional contact between the mating male end portion outer surface 348 and female end portion inner surface 350. These frictional forces function as retaining means to hold one segment 340 at any desired location relative to an interconnected segment 340. However, these frictional forces can be overcome permitting interconnected segments 340 to be moved relative to each other so that their longitudinal axes are either in or out of alignment and permitting unrestricted relative rotational movement therebetween. Thus, the static friction hold the segments in place and is overcome when a user initially starts moving the segments. Once in motion, the low dynamic friction that makes the segments 340 easy to move. This connection permits the attached cleaning pad 328 to have the same relative movements as the interconnected segments, as described above. The length of the elongated flexible cleaning pad support member 326 can be changed by adding or removing segments 340.

Figure 15:
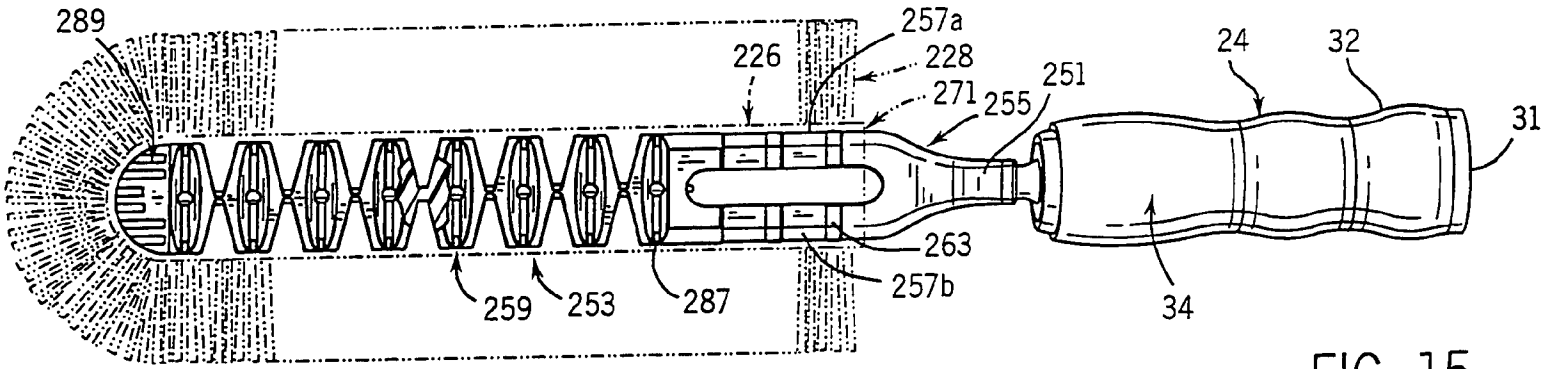
FIG. 15 is a perspective view of a fourth embodiment of an assembled flexible cleaning device combining the handle portion of the first embodiment with the cleaning head support of the second embodiment.
Figure 16:
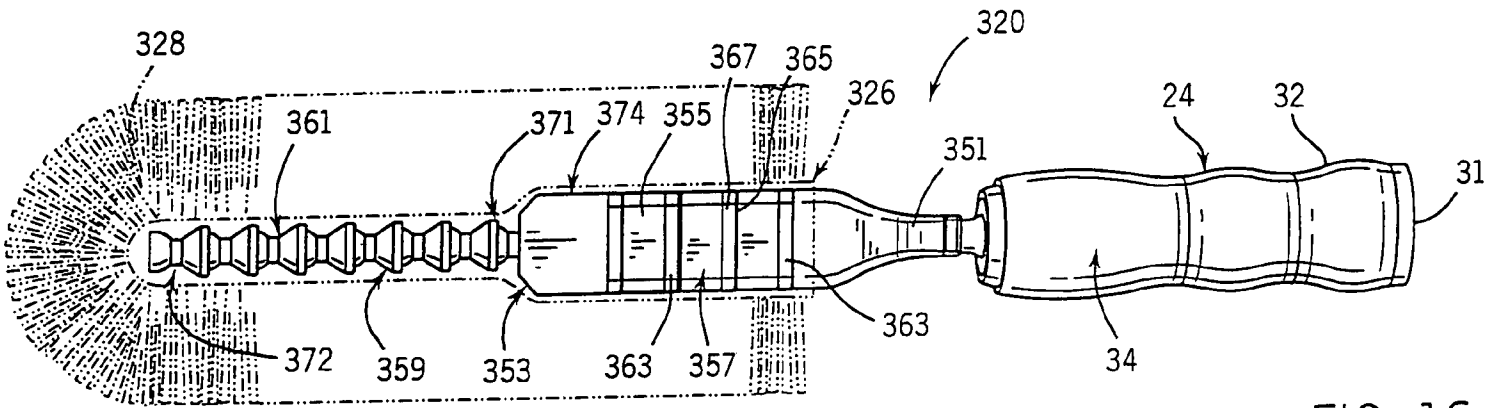
FIG. 16 is a perspective view of a fifth embodiment of an assembled flexible cleaning device combining the handle portion of the first embodiment with the cleaning head support of the third embodiment.

It should be understood that the component parts of the alternative embodiments can be interchanged. FIGS. 15 and 16 illustrate a fourth and fifth embodiment incorporating the handle portion 24 of the first embodiment with the cleaning head support members 226, 326 of the second and third embodiments respectively. Although not shown, it should be understood that the cleaning head support could be constructed entirely of the wire spine molded to the handle portion without the pivot member or a semi-rigid first part 255 in a manner similar to that described in reference to the first embodiment.

It is further concieved that the cleaning head support members 26, 226, 326 could be comprised of two smaller support members extending in parralel to one another and configured to fit within a cleaning pad having two parralel pockets, sleeves or support chambers. Such replaceable cleaning pads are disclosed in for example U.S. patent application Ser. Nos. 11/045,204, filed Jan. 28, 2005 and 11/124,527 filed May 6, 2005.

Methods of Use and Methods of Cleaning

It should be appreciated from the above disclosure that the preferred cleaning tools 22, 222, 322 can be utilized to clean or dust a variety of surfaces. Due to the unique configuration of the tool 22, 222, 322 a user can conveniently alternate the orientation of the cleaning tool 22, 222, 322. It is recognized that the component parts of the invention may be conveniently interchanged depending on the particular cleaning task at hand. For example, some of the disclosed cleaning pads 28 may be more suitable for use with some of the disclosed cleaning solutions or for dry dusting. Likewise, some cleaning pads 28 may include alternate surfaces configured for alternative cleaning tasks. Similarly, the particular cleaning solution utilized can be changed depending on the desired application.

In order to perform cleaning a user may obtain the above mentioned cleaning system 20, 220, 320 that includes the preferred cleaning tool 22, 222, 322. A user holds the cleaning tool 22, 222, 322 such that the palm of the users hand surrounds the handle portion 24, 224.

Once the user obtains the tool 22, 222, 322 a user then places the cleaning pad 28, 228, 328 onto the flexible cleaning pad support member 26, 223, 326. As noted above, the cleaning tool may be used with a variety of alternative cleaning pads. In the preferred embodiment, the sleeve-like cleaning pad 28, 228, 328 is mounted over the cleaning pad support member 26, 226, 326. Once secured, the user then positions the cleaning pad 28, 228, 328 onto a surface to be cleaned and moves the cleaning pad 28, 228, 328 on the surface to be cleaned. The movement of the cleaning pad 28, 228, 328 across the surface to be cleaned causes dust or other debris to be collected by the cleaning pad 28, 228, 328. In the illustrated embodiment, dust or other debris is collected by the cleaning surface of the cleaning pad 28, 228, 328. The user may, depending on the surface to be cleaned, move the cleaning pad support member 28, 228, 328 to accommodate hard to reach places. For example, if a user desires to dust an overhead lintel, the user may pivot the cleaning pad support member 26, 226, 326 to an angle of about 90° in relation to the handle portion 24, 224, 324.

A preferred dusting or cleaning pattern consists of a side to side overlapping motion starting in the upper left hand (or right hand) side of the section to be cleaned, and progressing the wiping pattern across the surface to be cleaned continuing to use side to side wiping motions. Another preferred wipe pattern consists of an up-and-down wiping motion. The preferred wiping patterns allow the cleaning pad 28, 228, 328 to loosen dirt and dust, and provide a better end result. Another benefit of the above wiping patterns is minimization of streaks as a result of improved spreading of solution (in wet dusting). Additionally a user can bend the support member 26, 226, 326 into a "U" shape, so as to provide twice the dusting surface passing over a given space.

Once the cleaning or dusting has been finished, the user may remove and dispose of the cleaning pad 28, 228, 328. As noted above, a variety of cleaning solutions can be used with the inventive cleaning system. In one preferred method of light cleaning or dusting a solution comprising 96.5125% by weight deionized water, 1.75% propan-2-ol anhydrous, 0.40% ethylene glycol monobutyl ether, 0.40% ethylene glycol n-hexyl ether, 0.125% propylene glycol, 0.10% monoethanolamine, 0.30% vinegar (white distilled 300 grain), and small amounts surfactants and other ingredients is utilized. This composition is ideally suited for dusting jobs. Use of the preferred solution with the inventive cleaning solution provides an increase in dust and allergen retention as well as providing an improved shine to the surface to be cleaned. Fingerprints, smudges and other blemishes are also easily removed.

Optionally, and most preferably, convenience and performance can be maximized by using a system composed of a disposable cleaning pad 28, 228, 328 as described hereinbefore. The pad can be composed of any one of the alternative cleaning pads described above.

Use of the embodiments illustrated in FIGS. 7-14 is similar to that described above, however, includes the additional option of application of a cleaning solution to the cleaning pad 228, 328 or directly to the surface to be cleaned. FIGS. 7-12 generally illustrate the cleaning systems 220, 320 in their cleaning positions. In the cleaning position the cleaning pad support member 226, 326 extends forwardly, pivot engagement tab 241 engages the cleaning position notch of pivot member, and retention tabs fit within the retention tab holes 247, 347. These engagement or retaining features create at least 2.5 lbf of pivot force. This amount of force is sufficient to maintain the cleaning pad support member 226, 326 in its fully extending cleaning position despite any torque experienced during normal dusting, drying, or cleaning motions. Thus, in the cleaning position, a user may manipulate the cleaning system 220, 320 via the handle portion 224 as well as adjust the flexible cleaning pad support member 226, 326. Additionally, the user may apply the water or other liquid housed within the fluid reservoir 233 directly onto the surface to be cleaned. The user may insert a finger through the opening 237 and depress the spray cap thereby causing the discharge of the fluid housed within the reservoir 233. Due to the orientation of the cleaning system 220, 320 in the cleaning position, the liquid will typically be applied directly to the surface to be cleaned in an area behind the cleaning pad 228, 328 when the system is in a horizontal orientation such as when dusting a coffee table. Alternatively, a cleaning solution can be sprayed onto a vertical surface to be cleaned, such as a window or door molding.

FIGS. 7 and 8 illustrate (in phantom) the cleaning system 220 in a second liquid application position. In order to move, the cleaning pad support member 226 into the liquid application position a user must hold the handle portion 224 and apply torque to the cleaning pad support member 226 to move it from the cleaning position illustrated. As sufficient torque is applied to overcome the forces of the inventive engagement features, the circular pivot member rotates downwardly into the liquid application position. In the liquid application position, pivot engagement tab 241 engages the liquid application notch of the pivot member thereby holding the cleaning pad support member 226, 326 is its angled liquid application state. In the illustrated embodiment, the angle between the cleaning pad support member 226, 326 and the handle portion 224 in the liquid application position may be between 45° and 68°. Preferably, the angle between the cleaning pad support member 226, 326 and the handle portion 224 is between 55° and 68° with 63° being particularly preferred. This preferred angle takes into consideration the spray pattern of the fluid reservoir in order to achieve liquid application onto the greatest surface area of the cleaning surface of the cleaning pad 228, 328.

During dusting or cleaning, a user may repeatedly rotate the cleaning pad support member 226, 326 from its cleaning position to its liquid application position as needed. Alternatively, as noted above, a user may simply apply liquid directly to the surface to be cleaned while using the cleaning system 220, 320 in the cleaning position.

Although not illustrated, the cleaning system 220, 320 also includes a storage position. In the storage position, the cleaning pad support member 226, 326 is rotated backwards such that it is generally parallel to the plane defined by the longitudinal axis of the handle portion 224. In this position, engagement tab 241 engages the storage position notch thereby maintaining cleaning pad support member 226 in its folded position. In the storage position, the cleaning system 220, 320 may be easily stored into a variety of spaces such as kitchen drawers or cabinets. Alternatively, the system can be hung on a wall using the opening 32 in the handle portion 24.

The described cleaning systems 22, 222, 322 and methods of use provide multiple benefits versus conventional cleaning modes. It reduces time to clean or dust, because the cleaning pad retains a greater amount of dust and the preferred cleaning solution removes fingerprints smudges and other surface marks. Additionally, since a fresh pad may be used every time, germs and dirt are trapped, removed and thrown away, promoting better hygiene. Conventional dusting tools, which are re-usable, can harbor dirt and germs, which can be spread throughout the household.

The cleaning pads are versatile in that they can be used for multiple cleanings and multiple surfaces. Each pad is designed to clean at least one average size surface with an average debris or dust load. Pads can be changed sooner if surfaces are larger than average, or especially dirty. To determine if the pad needs changing, visual inspection of the back of the cleaning surface of the cleaning pad will confirm if the cleaning surface is saturated with dust and/or dirt.

To maximize the synergy between the various cleaning, and dusting tasks, the present methods can be carried out using several varying executions and instructions for use. In one embodiment, a kit can be provided that has multiple cleaning pads and solutions for different cleaning tasks. One solution and cleaning pad could be used for surface cleaning and another solution and pad for dusting. The solution bottles and pads may be color coordinated by use. The kit may be sold separately with advertising and instructions in each kit being used to explain the benefits of using the various products together.

It is understood that the component parts of the inventive systems 20, 220, 320 described above may be manufactured and sold separately or together in the form of a cleaning system or kit. It should be further understood the present invention contemplates a variety of additional alternative configurations and component parts which may be attached to the cleaning pad support member. A wide variety of alternative interchangeable cleaning implements may be substituted for the cleaning pad support member 26, 226, 326 described above. For example, and in no way limiting, an alternative cleaning implements could include a squeegee for cleaning windows, mirrors or other glass structures, a soft surface cleaner such as a lint roller, a glass cleaner including an indexing refill roll, an insect swatter, a dog brush or other grooming implement, a scrub brush, sponge, mop, paint brush, toilet brush or other cleaning implement etc. Numerous other cleaning implements are also within the scope of the present invention.

Furthermore, although the preferred embodiment illustrates a flexible cleaning pad support 26, 226, 326 it is recognized that the present invention is in no way limited to such a construction. The cleaning pad support 26 could alternatively be connected to the handle portion via a threaded connection. Such an orientation would allow for the ease of attachment and removal of the numerous alternative cleaning implements that are within the scope of the present invention.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, as noted throughout the application the individual components need not be formed in the disclosed shapes, or assembled in the disclosed configuration, but could be provided in virtually any shape, and assembled in virtually any configuration, so as to provide for a cleaning system that includes a flexible support. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A cleaning device comprising:

a handle portion having an opening configured to allow access to a cradle that is configured to receive a fluid dispenser which is removably attachable to the cradle wherein the fluid dispenser dispenses fluid through a through-hole in the opening;

a cleaning pad support moveably attached to the handle portion, wherein the cleaning pad support is comprised of a plurality of rotatable interconnected segments each having a male end and a female end for connecting to an adjacent discrete rotatable interconnected segment; and a retaining means for retaining the cleaning pad support in a desired shape.

2. The cleaning device of claim 1, further comprising at least one cleaning pad enclosing the cleaning pad support, the at least one cleaning pad having a length substantially the same as the cleaning pad support.

3. The cleaning device of claim 1, wherein the cleaning pad support is comprised of a piece of wire insert-molded into a polymer.

4. The cleaning device of claim 3, wherein the piece of wire is insert-molded into a plurality of polymer vertabrae.

5. The cleaning device of claim 1, wherein the cleaning pad support is moveable between a first cleaning position and a second cleaning pad liquid application position.

6. The cleaning device of claim 5, further comprising a cleaning fluid dispenser within the cradle.

7. The cleaning device of claim 6, wherein the cleaning fluid dispenser comprises a pump spray bottle.

8. The cleaning device of claim 1, wherein the cleaning pad support is comprised of a two part support head comprising a semi-rigid first part pivotally attached to the handle portion and a flexible second part attached to the first part.

9. The cleaning device of claim 1, wherein the cleaning pad support comprises a circular pivot member at one end, the circular pivot member configured to fit within a pivot member receiving cavity in the handle portion.

10. The cleaning device of claim 9, wherein the circular pivot member comprises a plurality of notches and the handle comprises a semi-flexible engagement tab projecting downward into the pivot member receiving cavity, the engagement tab configured to fit within the notches for selective pivoting of the cleaning pad support.

11. The cleaning device of claim 10, wherein the pivot member comprises a first notch corresponding to a cleaning position, a second notch corresponding to a liquid application position, and a third notch corresponding to a storage position.

12. The cleaning device of claim 11, wherein the angle between the handle portion and cleaning pad support member is between 45 and 68 degrees in the liquid application position.

13. A cleaning system including:

(a) a cleaning tool comprising:

a handle having an exterior surface defining a graspable surface and having an interior recess formed generally opposite the exterior surface and configured to receive a fluid reservoir which is removably attachable; and a cleaning media support pivotally attached to the handle, the support configured for pivoting rearwardly from a cleaning position and including a portion moveable into a plurality of desired shapes;

(b) a cleaning media attached to the cleaning media support; and (c) a fluid reservoir attached to the handle in the recess, the reservoir capable of applying fluid to a surface to be cleaned and to the surface of the cleaning media.

14. The cleaning system of claim 13, wherein the cleaning media support is comprised of a two part support head comprising a semi-rigid first part pivotally attached to the handle portion and a flexible second part attached to the first part.

15. The cleaning system of claim 14, wherein the flexible second part is comprised of a plurality of interconnected segments.

16. The cleaning system of claim 14, wherein the flexible second part is comprised of a piece of wire insert-molded into a polymer.

17. The cleaning system of claim 16, wherein the piece of wire is insert-molded into a plurality of polymer vertabrae.

18. A method of cleaning comprising:

bending a flexible support member of a cleaning tool to a desired cleaning position, the cleaning tool comprising a handle having an exterior surface defining a graspable surface and having an interior cradle formed generally opposite the exterior surface and adapted for receiving a fluid reservoir which is removably attachable with respect to the handle;

applying a cleaning solution from a fluid reservoir in the handle having a through-hole for fluid dispensing to a surf ace to be cleaned or to a cleaning pad attached to the support member; and moving the cleaning pad across a surface to be cleaned.

19. A cleaning system including:

(a) a cleaning tool comprising:

a handle defining an interior recess for receiving a fluid reservoir which is removably attachable with respect to the handle; and a cleaning media support pivotally attached to the handle, the support capable of pivoting rearwardly from a cleaning position and including a portion moveable into a plurality of desired shapes and wherein the cleaning media support is comprised of a two part support head comprising a semi-rigid first part pivotally attached to the handle portion and a flexible second part attached to the first part and wherein the flexible second part is comprised of a plurality of interconnected segments;

(b) a cleaning media attached to the cleaning media support; and (c) a fluid reservoir attached to the handle in the recess, the reservoir capable of applying fluid to a surface to be cleaned and to the surface of the cleaning.

20. A cleaning system including:

(a) a cleaning tool comprising:

a handle defining an interior recess for receiving a fluid reservoir which is removably attachable with respect to the handle; and a cleaning media support pivotally attached to the handle, the support configured for pivoting rearwardly from a cleaning position and including a portion moveable into a plurality of desired shapes and wherein the cleaning media support is comprised of a two part support head comprising a semi-rigid first part pivotally attached to the handle portion and a flexible second part attached to the first part and wherein the flexible second part is comprised of a piece of wire insert-molded into a polymer;

(b) a cleaning media attached to the cleaning media support; and (c) a fluid reservoir attached to the handle in the recess, the reservoir capable of applying fluid to a surface to be cleaned and to the surface of the cleaning.

21. The cleaning system of claim 20, wherein the piece of wire is insert-molded into a plurality of polymer vertabrae.

* * * * *